US007853172B2

(12) United States Patent
Inoue et al.

(10) Patent No.: US 7,853,172 B2
(45) Date of Patent: Dec. 14, 2010

(54) IMAGE FORMING DEVICE WITH AGGREGATION-FORMING UNIT THAT REMOVES ADHERENTS

(75) Inventors: Satoshi Inoue, Kanagawa (JP); Masahiro Takagi, Kanagawa (JP); Koutarou Yoshihara, Kanagawa (JP); Moegi Iguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 326 days.

(21) Appl. No.: 12/101,342

(22) Filed: Apr. 11, 2008

(65) Prior Publication Data

US 2009/0010674 A1 Jan. 8, 2009

(30) Foreign Application Priority Data

Jul. 2, 2007 (JP) ..... 2007-174343

(51) Int. Cl.
*G03G 15/02* (2006.01)

(52) U.S. Cl. ..... 399/100

(58) Field of Classification Search ..... 399/100, 399/101, 174, 176, 252; 430/111.35
See application file for complete search history.

(56) References Cited

U.S. PATENT DOCUMENTS

| | | | | |
|---|---|---|---|---|
| 7,477,862 | B2 * | 1/2009 | Takaya et al. | 399/100 |
| 2002/0142242 | A1 | 10/2002 | Inoue et al. | |
| 2005/0191081 | A1 | 9/2005 | Muraishi et al. | |
| 2008/0019729 | A1 * | 1/2008 | Hoshio et al. | 399/100 |

FOREIGN PATENT DOCUMENTS

| | | | |
|---|---|---|---|
| CN | 1366213 A | | 8/2002 |
| JP | A 59-24416 | | 6/1984 |
| JP | B2 59-24416 | | 6/1984 |
| JP | 02022672 A | * | 1/1990 |
| JP | A 05-100493 | | 4/1993 |
| JP | A 08-3679 | | 1/1996 |
| JP | B2 08-3679 | | 1/1996 |

(Continued)

OTHER PUBLICATIONS

Jikkenho, "Physical Chemistry Experimental Methods", 1968, pp. 98-107, Tokyo Kagaku Dozin Co., Ltd., third edition.

(Continued)

*Primary Examiner*—Robert Beatty
(74) *Attorney, Agent, or Firm*—Oliff & Berridge, PLC

(57) ABSTRACT

An image forming device including: an image holding member; a charging member; a latent image-forming unit; a developing unit that develops the electrostatic latent image formed on the image holding member with a developer including a toner and a carrier, the toner comprising an external additive having first inorganic particles with a volume average particle diameter of 80 nm to 300 nm, and the carrier including a core material having a magnetic powder dispersed in a resin and a resin covering layer that covers the core material; a transfer unit; a removal unit; and an aggregation-forming unit that, by contacting a surface of the charging member and rotating in accordance with rotation of the charging member, removes adherents on the surface of the charging member, including the first inorganic particles, from the surface of the charging member, and forms aggregations in which the removed first inorganic particles are aggregated.

23 Claims, 3 Drawing Sheets

FOREIGN PATENT DOCUMENTS

| | | | | |
|---|---|---|---|---|
| JP | A 2001-201923 | | | 7/2001 |
| JP | A 2002-091053 | | | 3/2002 |
| JP | A 2002-221883 | | | 8/2002 |
| JP | 2005300996 | A | * | 10/2005 |
| JP | 2006154285 | A | * | 6/2006 |
| JP | 2006195154 | A | * | 7/2006 |
| JP | 2007127952 | A | * | 5/2007 |

OTHER PUBLICATIONS

Chinese Office Action issued Jul. 2, 2010 for Chinese Application No. 200810091467.6 (with translation).

* cited by examiner

IMAGE FORMING DEVICE WITH AGGREGATION-FORMING UNIT THAT REMOVES ADHERENTS

CROSS-REFERENCE TO RELATED APPLICATION

This application is based on and claims priority under 35 USC 119 from Japanese patent Application No. 2007-174343 filed on Jul. 2, 2007.

BACKGROUND

1. Technical Field

The present invention relates to an image forming device.

2. Related Art

Image forming devices are known which use an electrophotography system. In such an image forming device, a surface of an image holding member such as a photoreceptor or the like, which is for holding electrostatic latent images, is charged by an electrostatic charging apparatus, and an electrostatic latent image is formed on the charged image holding member. Then, the electrostatic latent image is developed with a developer and thus a toner image is formed on the image holding member. The toner image formed on the image holding member is transferred to a recording medium, directly to the recording medium or via a transfer roller, and is then fixed to the recording medium. Adherents on the image holding member, such as residual toner, paper dust and the like, are removed by a cleaning apparatus.

For the charging of the image holding member by the charging apparatus, in order to facilitate suppression of ozone generation amounts and a reduction in size of the image forming device, a contact-type charging apparatus is used. At such a contact-type charging apparatus, charging of the image holding member surface is performed by causing a cylindrical charging roller to contact the surface of the image holding member. However, toner components at the image holding member surface, such as external additives and the like, that have not been removed by the cleaning apparatus may adhere to a surface of the charging roller.

SUMMARY

According to an aspect of the present invention, there is provided an image forming device comprising:

an image holding member that is driven to rotate;

a charging member that, by contacting a surface of the image holding member and rotating in accordance with rotation of the image holding member, contact-charges the image holding member;

a latent image-forming unit that forms an electrostatic latent image on the image holding member that has been charged by the charging member, a developing unit that develops the electrostatic latent image formed on the image holding member with a developer including a toner and a carrier to form a toner image in accordance with the electrostatic latent image, the toner comprising an external additive having first inorganic particles with a volume average particle diameter of 80 nm to 300 nm, and the carrier including a core material having a magnetic powder dispersed in a resin and a resin covering layer that covers the core material;

a transfer unit that transfers the toner image to a transfer-receiving member;

a removal unit that removes adherents on the image holding member; and an aggregation-forming unit that, by contacting a surface of the charging member and rotating in accordance with rotation of the charging member, removes adherents that have adhered to the surface of the charging member, including the first inorganic particles, from the surface of the charging member, and forms aggregations in which the removed first inorganic particles are aggregated.

BRIEF DESCRIPTION OF THE DRAWINGS

Exemplary embodiments of the present invention will be described in detail based on the following figures, wherein.

DETAILED DESCRIPTION

Herebelow, an exemplary embodiment of the present invention will be described.

Figure 1:
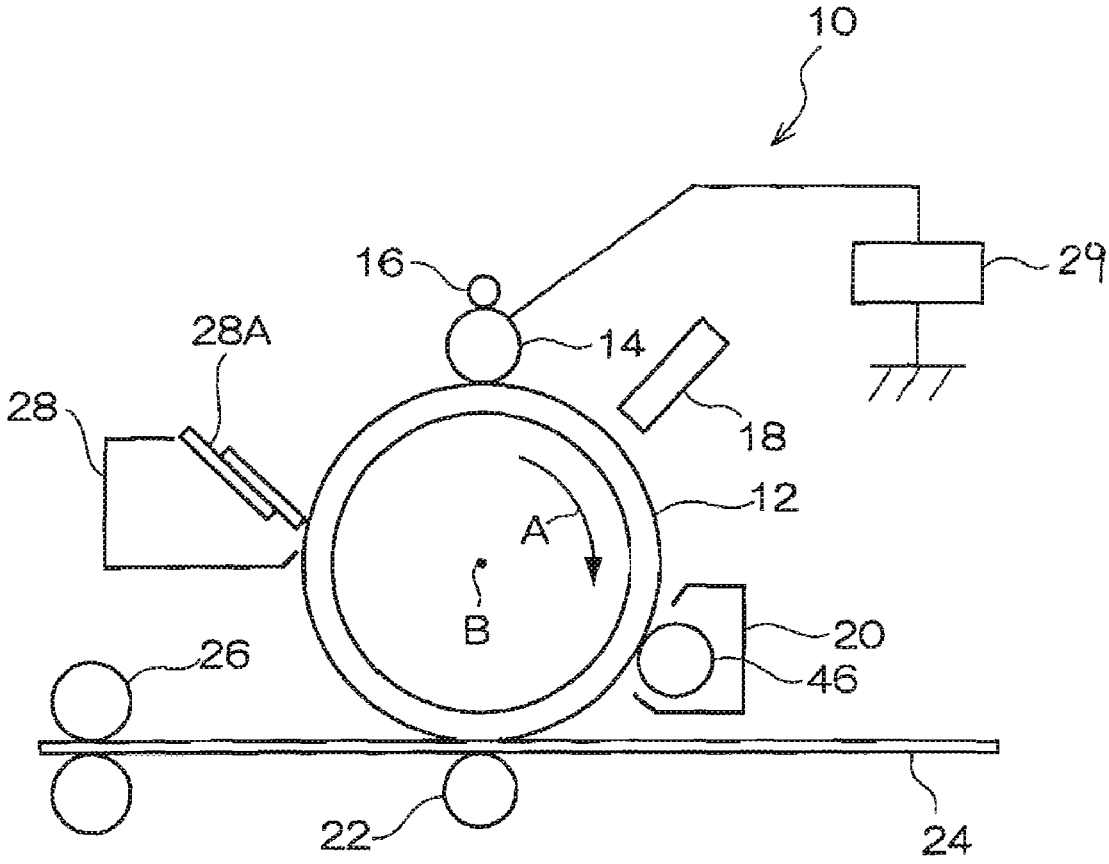
FIG. 1 is a schematic sectional view showing basic structure of one exemplary embodiment of the image forming device of the present invention.

As shown in FIG. 1, an image forming device 10 of the present exemplary embodiment is structured to include an image holding member 12. The image holding member 12 is structured with a cylindrical shape, and is driven to rotate in a predetermined direction (the direction of arrow A in FIG. 1) around a rotation axis B by an unillustrated driving mechanism.

A charging roller 14, an exposure apparatus 18, a developing apparatus 20, a transfer apparatus 22 and a cleaning apparatus 28 are provided around the image holding member 12, along the direction of rotation of the image holding member 11 (the direction of arrow A in FIG. 1). A fixing apparatus 26 and a cleaning roller 16 are also provided in the image forming device 11.

Herein, the image holding member 12 corresponds to an image holding member of the image forming device according to the present invention, the charging roller 14 corresponds to a charging member of the image forming device according to the present invention, and the exposure apparatus 18 corresponds to a latent image-forming unit. Moreover, the developing apparatus 20 corresponds to a developing unit of the image forming device according to the present invention, the transfer apparatus 22 corresponds to a transfer unit, and the cleaning apparatus 28 corresponds to a removal unit. Further still, the cleaning roller 16 corresponds to an aggregation-forming unit of the image forming device according to the present invention.

The charging roller 14 electrostatically charges a surface of the image holding member 12. The exposure apparatus 18 forms an electrostatic latent image by exposing the image holding member 12 which has been charged by the charging roller 14. The developing apparatus 20 develops the electrostatic latent image that has been formed on the image holding member 12 with a developer that was stored beforehand, forming a toner image in accordance with the electrostatic latent image. The transfer apparatus 22 transfers the toner image that has been formed on the image holding member 12 to a recording medium 24. The fixing apparatus 26 fixes the toner image that has been transferred onto the recording medium 24 to the recording medium 24. The cleaning apparatus 28 is structured to include a cleaning blade 28A, which is provided contacting the surface of the image holding member 12, and removes adherents such as toner and the like on the image holding member 12 from the image holding member 12 with the cleaning blade 28A.

Firstly, a developer to be used in the image forming device 10 of the present exemplary embodiment will be described.

The developer to be used in the present exemplary embodiment is constituted to include a toner and a carrier. Inorganic particles with a volume average particle diameter of 80 nm (or about 80 nm) to 300 nm (or about 300 nm) are externally added to the toner. The carrier is constituted to include a core material, in which magnetic powder is dispersed in resin, and a resin covering layer, which covers the core material. The inorganic particles are externally added to toner parent particles.

First, the inorganic particles which are externally added to the toner will be described.

As mentioned above, the volume average particle diameter of the inorganic particles should be in a range from 80 nm to 300 nm, is preferably in a range from 80 nm to 250 nm, and is more preferably in a range from 80 nm to 200 nm.

If the volume average particle diameter of the inorganic particles were less than 80 nm, a problem might arise in that it would be difficult to detach the inorganic particles from the toner at a blade nipping portion. Therefore, a dam that was formed by the inorganic particles would be small. As a result, toner would enter deep into the blade nipping portion, would consequently be stressed and deformed, and would slip past the blade, and the charging roller would be soiled with toner. On the other hand, if the volume average particle diameter exceeded 300 nm, the inorganic particles would be easily detached from the toner at the blade nipping portion but, because such a diameter is too large, if any of the inorganic particles were to slip past the blade nipping portion, the blade would be damaged and hence toner would slip past.

A method for measuring the volume average particle diameter of the inorganic particles will be described later An inclusion amount of the inorganic particles at the surface of the toner parent particles is from 0.5% by weight (or about 0.5% by weight) to 2.5% by weight (or about 2.5% by weight), preferably from 0.8% by weight to 2.53% by weight, and more preferably from 1.2% by weight to 2.5% by weight.

If the inclusion amount of the inorganic particles into the toner parent particles is less than 0.5% by weight, amounts of inorganic particles that are detached will be small. Therefore, it may not be possible to dam tip the toner at the blade nipping portion, and the toner itself may manage to slip past. On the other hand, if the inclusion amount of the inorganic particles into the toner parent particles exceeds 2.5% by weight, amounts of the inorganic particles that slip past the blade may be larger, and a rate at which the charging roller soils may be faster and be excessive.

In the present exemplary embodiment, in addition to the inorganic particles having a volume average particle diameter in the range from 80 nm to 300 nm, it is possible to combine the inorganic particles with an external additive with a smaller diameter (below referred to as a 'small-diameter external additive').

By using an external additive with such a particle diameter (the small-diameter external additive), it is possible to assure fluidity of the toner.

A volume average particle diameter of this small-diameter external additive is preferably in a range from 7 nm (or about 7 nm) to 60 nm (or about 60 nm), and more preferably in a range from 10 nm to 50 nm.

A method for measuring the volume average particle diameter of the small-diameter external additive will be described later.

The small-diameter external additive may be used in a range from 0.5% by weight (or about 0.5% by weight) to 3.0% by weight (or about 3.0% by weight) relative to a weight of toner, and is preferably used in a range from 0.8% by weight to 2.0% by weight.

If the amount of the small-diameter external additive is less than 0.5% by weight, fluidity of the toner will be low. On the other hand, if the amount exceeds 3.0% by weight, fluidity of the toner will be excellent, but it will be difficult to apply the small-diameter external additive to the toner surfaces substantially uniformly. Rather, aggregations may be left which, depending on circumstances, may impede coloring characteristics of the toner.

Now, the method for measuring volume average particle diameter will be described.

The above-mentioned inorganic particles and small-diameter external additive of the present exemplary embodiment are both measured using a laser diffraction-scattering-type particle size distribution measuring instrument (HORIBA LA-910). Sodium polyphosphate is added, to 0.1%, into a 0.5% aqueous solution of an anionic surfactant (NEWREX PASTE H, produced by NOF Corporation). To this, the inorganic particles or small-diameter external additive to be measured is added, and this is dispersed by ultrasound for 1 minute and used as a measurement sample.

In the present exemplary embodiment, inorganic particles as illustrated below are used as the inorganic particles.

That is, inorganic particles of $SiO_2$, $TiO_2$, $TiO(OH)_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$ and the like can be used. Among these, in particular, cases with silica particles and titania particles give excellent toner fluidity, and are therefore preferable. Further, cleaning assistants, transfer assistants and the like can also be used, such as polystyrene particles, polymethyl methacrylate particles, polyvinylidene fluoride particles, small-diameter amorphous resin particles, cerium oxide, zinc stearate and so forth.

The surfaces of the inorganic particles may have been subjected to a hydrophobizing treatment beforehand. Particle fluidity of the toner is improved by this hydrophobizing treatment, and the treatment is also useful in regard to dependency of charging on environmental conditions and resistance to carrier contamination. The hydrophobizing treatment can be performed by immersing the inorganic particles in a hydrophobizing treatment agent, or the like. The hydrophobizing treatment agent is not particularly limited, but may be, for example, a silane-based coupling agent, a silicone oil, a titanate-based coupling agent, an aluminum-based coupling agent or the like. One of these may be used alone, or two or more may be used in combination. Among these, silane-based coupling agents are excellent.

As a silane-based coupling agent, it is possible to use, for example, any type from chlorosilanes, alkoxysilanes, silazanes and particular silylating agents. Specifically, the following can be mentioned: methyl trichlorosilane, dimethyl dichlorosilane, trimethyl chlorosilane, phenyl trichlorosilane, diphenyl dichlorosilane, tetramethoxysilane, methyl trimethoxysilane, dimethyl dimethoxysilane, phenyl trimethoxysilane, diphenyl dimethoxysilane, tetraethoxysilane, methyl triethoxysilane, dimethyl diethoxysilane, phenyl triethoxysilane, diphenyl diethoxysilane, isobutyl triethoxysilane, decyl trimethoxysilane, hexamethyl disilazane, N,O-(bis-trimethyl silyl)acetamide, N,N-(trimethyl silyl)urea, tert-butyl dimethyl chlorosilane, vinyl trichlorosilane, vinyl trimethoxysilane, vinyl triethoxysilane, γ-methacryloxypropyl trimethoxysilane, β-(3,4-epoxy cyclohexyl)ethyl trimethoxysilane, γ-glycidoxypropyl trimethoxysilane, γ-glycidoxypropyl methyl diethoxysilane, γ-mercaptopropyl trimethoxysilane, γ-chloropropyl trimethoxysilane, and the like.

A usage amount of the hydrophobizing treatment agent will differ depending on the type of inorganic particles and suchlike, and cannot be defined for all cases, but a range from 5 parts by weight (or about 5 parts by weight) to 50 parts by weight (or about 50 parts by weight) for 100 parts by weight of organic particles will be usually suitable.

A degree of hydrophobicity of the external additive that is caused by the hydrophobizing treatment agent is preferably from 40% (or about 40%) to 100% (or about 100%), more preferably from 50% to 100%, and even more preferably from 60% to 100%. For the present invention, the degree of hydrophobicity is defined as a hydrophobicity (M) represented by the following formula, when 0.2 g of particles are added to 50 cc of water, stirred with a stirrer and then titrated with methanol, and a methanol titer amount when the particles are all suspended in solution is Tcc.

$$\text{Hydrophobicity}(M)=[T/(50+T)]\times 100(\text{vol. }\%)$$

In order for the above-described inorganic particles to not damage a cleaning blade, the inorganic particles preferably have spherical shapes.

As a definition of these spherical shapes, the Wadell sphericity shown below can be considered. The externally added spherical particles to be used in the present invention preferably have sphericity of at least 0.6 (or at least about 0.6), and more preferably at least 0.8.

For the sphericity, the Wadell true sphericity (the following equation) is employed.

A surface area of a sphere with the same volume as an actual particle is (a), a surface area of the actual particle is (b), and $$\text{Sphericity}=(a)\div(b)$$

(a) is found by measurement using a laser diffraction-scattering-type particle size distribution measuring instrument (HORIBA LA-910) and calculating from a volume average particle diameter.

Using a SHIMADZU particle specific surface area measurement instrument SS-100, (b) is substituted with a BET specific surface area.

The toner of the present exemplary embodiment includes a binder resin and a coloring agent, and as necessary, the above-described inorganic particles and small-diameter external additives are externally added to toner parent particles which include a release agent and other components.

Next, constituent components of the toner parent particles will be described in more detail.

—Binder Resin—

As the binder resin to be used in the toner parent particles, known resins may be used. With regard to obtaining excellent low-temperature fixability, a crystalline resin or a combination of a crystalline resin and a non-crystalline resin may be used.

As binder resins, homopolymers and copolymers of the following can be exemplified: styrenes such as styrene, chlorostyrene and the like: monoolefins such as ethylene, propylene, butylene, isoprene and the like; vinyl esters such as vinyl acetate, vinyl propionate, vinyl benzoate, vinyl acetate and the like; α-methylene fatty monocarboxylate esters such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate and the like; vinyl ethers such as vinyl methyl ether, vinyl ethyl ether, vinyl butyl ether and the like; vinyl ketones such as vinyl methyl ketone, vinyl hexyl ketone, vinyl isopropenyl ketone and the like; and the like.

As representative binder resins, the following can be mentioned: polystyrenes, styrene-alkyl acrylate copolymers, styrene-alkyl methacrylate copolymers, styrene-acrylonitrile copolymers, styrene-butadiene copolymers, styrene-maleic anhydride copolymers, polyethylenes, polypropylenes and the like. Polyesters, polyurethanes, epoxy resins, silicone resins, polyamides, denatured rosins, paraffin waxes and the like can also be mentioned.

Of these, styrene-alkyl acrylate copolymers and styrene-alkyl methacrylate copolymers are preferable.

Specific examples of crystalline resins include polyester resins of dicarboxylic acids of long-chain alkyls with diols of long chain alkyls or alkenyls, and vinyl resins of (meth) acrylates of long-chain alkyls and alkenyls. Examples of the dicarboxylic acids of long-chain alkyls include adipic acid, pimelic acid, suberic acid, azelaic acid, sebacic acid, dodecanedioic acid, and tridecanedioic acid. Examples of the diols of long-chain alkyls or alkenyls include butane diol, pentane diol, hexane diol, heptane diol, octane diol, nonane diol, decane diol, and batyl alcohol. Examples of the long-chain alkyls and alkenyls for the vinyl resins include amyl(meth) acrylate, hexyl(meth)acrylate, heptyl(meth)acrylate, octyl (meth)acrylate, nonyl(meth)acrylate, decyl(meth)acrylate, undecyl(meth)acrylate, tridecyl(meth)acrylate, myristyl (meth)acrylate, cetyl(meth)acrylate, stearyl (meth)acrylate, oleyl(meth)acrylate, and behenyl(meth)acrylate. Polyester resin-based crystalline resins are preferable with regard to adhesiveness to a recording medium such as paper or the like at a time of fixing, chargeability and the like, and ease of adjustment of fusing points to desired ranges.

—Coloring Agent—

The coloring agent of the toner parent particles is not particularly limited and both pigments and dyes can be used, but pigments are preferable with regard to light-resistance and water-resistance.

As pigments, the following known pigments may be used: Carbon Black, Aniline Black, Aniline Blue, Chalcoyl Blue, Chrome Yellow, Ultramarine Blue, Dupont Oil Red, Quinoline Yellow, Methylene Blue Chloride, Phthalocyan Blue, Malachite Green Oxalate, Lamp Black, Rose Bengal, Quinacridone, Benzidine Yellow, C.I. Pigment Red 48:1, C.I. Pigment Red 57:1, C.I. Pigment Red 122, C.I. Pigment Red 185, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, C.I. Pigment Blue 15:3, and the like.

It is also possible to use a magnetic powder as the coloring agent. As magnetic powders, known magnetic materials such as the following may be used: ferromagnetic metals such as cobalt, iron, nickel and the like; and alloys, oxides and the like of metals such as cobalt, iron, nickel, aluminum, lead, magnesium, zinc, manganese and the like. The above coloring agents can be used singly, and may be used in combinations of two or more.

Color toners such as yellow toner, magenta toner, cyan toner and black toner, or the like, can be obtained by selecting types of coloring agents.

An inclusion amount of the coloring agent to be included in the toner is preferably from 0.1 parts by weight to 40 parts by weight relative to 100 parts by weight of the toner parent particles, and more preferably from 1 part by weight to 30 parts by weight.

—Other Internal Components—

As necessary, other components may be internally added to the toner of the present exemplary embodiment, such as a release agent, a charge control agent and the like. Release agents are generally used with the objective of improving releasing characteristics. Specific examples of release agents include: low molecular weight polyolefins such as polyethylene, polypropylene, polybutene and the like; silicones that show a softening point upon heating; fatty amides such as oleic acid amide, erucic acid amide, ricinoleic acid amide, stearic acid amide and the like; plant-based waxes such as carnauba wax, rice wax, candelilla wax, Japanese wax, Jojoba oil and the like; animal-based waxes such as beeswax and the like; mineral- and oil-based waxes such as montan wax, ozokerite, ceresin, paraffin wax, microcrystalline wax, Fischer-Tropsch wax and the like; ester-based waxes such as fatty esters, montanic acid esters, carboxylic acid esters and the like; and the like. These release agents may be used singly, or two or more types may be used in combination.

An inclusion amount of the release agent is preferably from 1 part by weight (or about 1 part by weight) to 20 parts by weight (or about 20 parts by weight) relative to 100 parts by weight of the toner (the toner parent particles), and more preferably 2 to 15 parts by weight. If the amount is less than 1 part by weight, the addition of the release agent may have no effect. If the amount is more than 20 parts by weight, adverse effects on charging characteristics are likely to be expressed, and the toner may be susceptible to being broken up inside the developing apparatus. Hence, effects such as the release agent, the toner resin and the like becoming spent on the carrier, electric charge being easily lost, and the like may arise. In addition, when, for example, color toner is used, exudation into an image surface at a time of fixing is likely to be insufficient, and the release agent is likely to be left in the image, as a result of which transparency may be worse, which would not be preferable.

A fusing point of the release agent is preferably from 50° C. to 120° C., and is more preferably from 60° C. to 100° C. If the fusing point of the release agent is less than 60° C., a transformation temperature of the release agent will be too low, anti-blocking characteristics may deteriorate, and developing characteristics may be poor when the temperature inside the photocopier is high.

Furthermore, as necessary, a charge control agent may be added to the toner parent particles. As the charge control agent, known charge control agents may be used, Charge control agents such as azo-based metal complex compounds, metal complex compounds of salicylic acid, and resin based charge controlling agents which include polar groups may be used.

If the toner is to be fabricated by a wet process, it is preferable to use materials which are resistant to dissolution in water, with regard to controlling ionic strength and reducing effluent pollution.

For fabrication of the toner parent particles, known wet processes and dry processes can be used. For example, the following may be used: a mixing and pulverizing process in which the binder resin, the coloring agent and as necessary the release agent, charge control agent and so forth are mixed, pulverized and classified; a process in which particles provided by the mixing and pulverizing process are altered in shape by mechanical impact forces or heat energy; an emulsion polymerization process in which polymerizable monomers for providing the binder resin are emulsion-polymerized and the resultant dispersion liquid is mixed with a dispersion liquid in which the coloring agent is dispersed and one or more optional dispersion liquids in which the release agent, charge control agent and the like are dispersed, and then heated to cause aggregation and fusing to provide the toner; a suspension polymerization process in which polymerizable monomers for providing the binder resin are suspended in an aqueous solvent, with a solution of the coloring agent and as necessary the release agent, charge control agent and so forth, and polymerized: a dissolution suspension method in which the binder resin and a solution of the coloring agent and as necessary the release agent, charge control agent and so forth are suspended in an aqueous solvent and granulated; and the like.

It is further possible to use toner parent particles obtained by the above methods as core particles, applying resin particles thereto and then fusing by heating to fabricate toner parent particles with a core-shell structure, Then, a toner according to the present invention may be provided by adding to the toner parent particles obtained in such manner the aforementioned inorganic particles with the volume average particle diameter of 80 nm to 300 nm and, as necessary, the small-diameter external additive particles with the volume average particle diameter of 10 nm to 60 nm, and mixing.

The mixing of the toner parent particles with the external additives can be carried out by known methods such as, for example, a V blender; a Henschel mixer, a Loedige mixer and the like.

Further, as necessary, oversize particles in the toner that is obtained may be removed using an oscillation sifters an air-flow sifter or the like.

The particle diameter of the toner parent particles provided as described above is preferably a small diameter with regard to improving image quality. However, if the particle diameter is very small, developing in conventional systems will be difficult in regard to charging and fluidity. With regard to these points, the volume average particle diameter of the toner parent particles is preferably in a range from 2 μm to 8 μm, and is more preferably in a range from 4 μm to 7 μm.

If the volume average particle diameter of the toner parent particles exceeds 8 μm, image characteristics such as reproduction of fine lines, granularity of halftones and the like will be poorer, and when a photographic image or the like is being printed, it may be difficult to provide excellent image quality. On the other hand, if the volume average particle diameter of the toner parent particles is less than 2 μm, powder characteristics and charging characteristics will be very poor, and high speed printing from a conventional image forming device may be difficult.

A value of (volume average particle diameter/number average particle diameter), which is an index of a particle size distribution, is preferably at most 1.6 (or at most about 1.6), and more preferably at most 1.5. If this value is larger than 1.6, a spread of the particle size distribution will be large and consequently a distribution of charge amounts will be broad, and reverse-charging of toner and low-charging of toner are more likely to occur.

For the present invention, the volume average particle diameter of the toner parent particles (a cumulative volume average particle diameter $D_{50}$), the number average particle diameter (a cumulative number average particle diameter $D_{50P}$) and various particle size distribution indices can be measured using a COULTER MULTISIZER II (produced by BECKMAN COULTER), using ISOTON II (produced by BECKMAN COULTER) as an electrolyte.

At a time of measurement, 0.5 mg to 50 mg of a measurement sample of is added to 2 mL of a 5% aqueous solution of a surfactant (sodium alkyl benzene sulfonate is preferable), which serves as a dispersing agent. This is then added to 100 mL to 150 mL of an electrolyte.

The electrolyte in which the sample is suspended is subjected to 1 minute of dispersion processing in an ultrasonic dispersion device, and the particle size distribution of the particles with particle diameters in the range of 2 to 60 μm is measured with the COULTER MULTISIZER II, using an aperture of 100 μm as an aperture diameter. The number of particles that are sampled is 50,000.

On the basis of the particle size distribution measured in this manner, volumes and numbers in particle size ranges (channels) are plotted in respective cumulative distributions, accumulating from the small diameter side. Particle diameters for accumulations of 16% are defined as a cumulative volume average particle diameter $D_{16V}$ and a cumulative number average particle diameter $D_{16P}$, particle diameters for accumulations of 50% are defined as a cumulative volume average particle diameter $D_{50V}$ and a cumulative number average particle diameter $D_{50P}$, and particle diameters for accumulations of 84% are defined as a cumulative volume average particle diameter $D_{84V}$ and a cumulative number average particle diameter $D_{84P}$.

Using these, a volume average particle diameter distribution index ($GSD_V$) is calculated as $(D_{84V}/D_{16V})^{1/2}$, and a number average particle diameter distribution index ($GSD_P$) is calculated as $(D_{84P}/D_{16P})^{1/2}$.

Next, the carrier will be described.

The carrier to be included in the developer of the present exemplary embodiment is constituted to include a core material, in which a magnetic powder is dispersed in resin, and a resin covering layer that covers the core material.

First constitution of the carrier according to the present invention will be described.

—Carrier Core Material—

The core material of the carrier according to the present invention is formed by dispersing a magnetic powder in a resin.

As the magnetic powder, for example, the following may be used: a magnetic metal such as iron, steel, nickel, cobalt or the like; an alloy of such a magnetic metal with manganese, chrome, a rare earth element or the like (for example, a nickel-iron alloy, a cobalt-iron alloy, an aluminum-iron alloy or the like); a magnetic oxide such as ferrite, magnetite or the like; or the like. Among these, iron oxide is preferable, having advantages in stability of characteristics and low toxicity.

Such magnetic powders may be used singly and may be used in combinations of two or more.

A particle diameter of the magnetic powder is preferably from 0.01 μm (or about 0.01 μm) to 1 μm (or about 1 μm), more preferably from 0.03 μm to 0.5 μm, and even more preferably from 0.05 μm to 0.35 μm. If the particle diameter of the magnetic particles is less than 0.01 μm, a reduction in magnetism may result, or viscosity of a composition solution may be larger and the core material may not be provided with a homogeneous particle diameter. On the other hand, if the particle diameter of the magnetic particles exceeds 1 μm, it may not be possible to obtain the core material with consistent quality.

An inclusion amount of the magnetic particles in the carrier core material is preferably from 30% by weight (or about 30% by weight) to 99% by weight (or about 99% by weight), more preferably from 45% by weight to 98% by weight, and even more preferably from 60% by weight to 98% by weight. If the inclusion amount is less than 30% by weight, magnetic strength of each carrier particle will be low and restraining force may not be provided. Hence, flying dispersal and the like may result. If the inclusion amount exceeds 95% by weight, a magnetic brush constituted by the carrier may be hard and may break easily. In addition, stresses on the toner will be increased, and images may be coarser.

As the resin component constituting the core material of the carrier, cross-linked styrene-based resins, acryl-based resins, styrene-acryl-based copolymer resins, phenol-based resins and the like can be mentioned.

Depending on objectives, the core material of the carrier may further include other components.

As other components, for example, a charge control agent, fluorine-containing particles and the like can be mentioned.

For a method of fabrication of the core material of the carrier, for example, the following are known: a fusion-mixing process (Japanese Patent Application Publication (JP-B) Nos. 59-24416 and 8-3679, etc.) in which the magnetic powder and an insulative resin such as a styrene-acryl resin or the like are fused and mixed using a Bunbury mixer, a kneader or the like, cooled, and then pulverized and classified; a suspension polymerization process (Japanese Patent Application Laid-Open (JP-A) No. 5-100493, etc.) in which monomers for forming a binder resin and the magnetic powder are dispersed in a solvent to prepare a suspension, and this suspension is polymerized; a spray-dry process in which the magnetic powder is mixed and dispersed in a resin solution and then spray-dried; and the like.

The above-mentioned fusion-mixing process, suspension polymerization process and spray-dry process all include steps of preparing the magnetic powder beforehand by some means, mixing this magnetic powder with a resin solution, and dispersing the magnetic powder in the resin solution.

Moreover, materials obtained by sintering a metal such as iron, cobalt, nickel or the like or an alloy or compound such as magnetite, hamatite, ferrite or the like, singly or in combination, and the like may also be used as known materials.

—Resin Covering Layer—

The carrier of the present exemplary embodiment includes a resin covering layer which covers the above-described core material.

As a material of this resin covering layer, a known matrix resin that can be used as a material of the resin covering layer for the carrier may be used, and two or more types of resin may be blended and used.

Matrix resins that constitute resin covering layers can be broadly divided into charge-enabling resins, for contributing to chargeability of the toner, and low surface energy resins, which are used for preventing migration of toner components (external additives and the like) into the carrier.

Herein, as charge-enabling resins for contributing negative chargeability to the toner, amino-based resins, for example, urea-formaldehyde resins, melamine resins, benzoguanamine resins, urea resins and polyamide resins, and epoxy resins and the like can be mentioned. The following can be also be mentioned: polyvinyl and polyvinylidene resins, acryl resins, polymethyl methacrylate resins, polystyrene-based resins such as styrene-acryl copolymer resins and the like, polyacrylonitrile resins, polyvinyl acetate resins, polyvinyl alcohol resins, polyvinyl butyral resins, cellulose-based resins such as ethyl cellulose resins and the like, and the like.

Further, as charge-enabling resins for contributing positive chargeability to the toner, polystyrene resins, halogenated olefin resins such as polyvinyl chloride and the like, polyester-based resins such as polyethylene terephthalate resins, polybutylene terephthalate resins and the like, polycarbonate-based resins, and the like can be mentioned.

As low surface energy resins to be used to prevent movements of toner components into the carrier the following can be mentioned: polyethylene resins, polyvinyl fluoride resins, polyvinylidene fluoride resins, polytrifluoroethylene resins, polyhexafluoropropylene resins, a copolymer of vinylidene fluoride and an acryl monomer, a copolymer of vinylidene fluoride and vinyl fluorides a fluoro terpolymer such as a terpolymer of tetrafluoroethylene, vinylidene fluoride and a non-fluoride monomer or the like, silicone resins, and the like.

With the objective of resistance adjustment, conductive particles may also be added to the resin covering layer. As the conductive particles, metallic powders, carbon black, titanium oxide, tin oxide, zinc oxide and the like can be mentioned. Such conductive particles may have an average particle diameter of 1 μm or less. As necessary, plural types of conductive particles may be used in combination.

An inclusion amount of the conductive particles in the resin covering layer is preferably from 1% by weight (or about 1% by weight) to 50% by weight (or about 50% by weight) with regard to preserving strength of the resin covering layer and adjusting resistance of the carrier, and is more preferably from 3% by weight to 20% by weight.

In the present exemplary embodiment, 'insulative' means volume resistivities in a range above $10^{14}$ Ω·cm, and 'conductive' means volume resistivities in a range below $10^{7}$ Ω·cm. Further, 'semiconductive' means, for example, volume resistivities from $10^{7}$ Ω·cm to $10^{13}$ Ω·cm.

Here, for measurement of a volume resistivity, based on JIS-K-6911 (1995) (which is incorporated herein by reference), a round electrode is used (a UR PROBE of a HIRESTA IP, produced by Mitsubishi Chemical Corporation, which is a cylindrical electrode with external diameter 16 norm and a ring-form electrode portion with internal diameter 30 mm and external diameter 40 mm). In an environment of 22° C./55% RH, a voltage of 100 V is applied, and a current value 5 seconds after the application is measured using a microammeter R8340A, produced by Advantest. The volume resistivity is found from a volume resistance according to this current value.

For purposes of charge control, resin particles may also be included in the resin covering layer. As a resin constituting the resin particles, it is possible to use a thermoplastic resin, a thermosetting resin or the like.

In a case with a thermoplastic resin, the following can be mentioned: polyolefin-based resins, for example, polyethylene and polypropylene; polyvinyl- and polyvinylidene-based resins, for example, polystyrenes, acryl resins, polyacrylonitriles, polyvinyl acetates, polyvinyl alcohols, polyvinyl butyrals, polyvinyl chlorides, polyvinyl carbazols, polyvinyl ethers and polyvinyl ketones; vinyl chloride-vinyl acetate copolymers; styrene-acrylic acid copolymers; straight silicon resins structured with organosiloxane bonds, and denatured versions thereof, fluoride resins, for example, polytetrafluoroethylenes, polyvinyl fluorides, polyvinylidene fluorides and polychlorotrifluoroethylenes; polyesters; polycarbonates; and the like.

As examples of thermosetting resins, the following can be mentioned: phenol resins; amino resins, for example, urea-formaldehyde resins, melamine resins, benzoguanamine resins, urea resins and polyamide resins; epoxy resins; and the like.

An average thickness of the resin covering layer is preferably from 0.1 μm (or about 0.1μ) to 5 μm (or about 5 μm), more preferably from 0.3 μm to 3.0 μm, and even more preferably from 0.3 μm to 2.0 μm. If the average thickness of the resin covering layer is less than 0.1 μm, it may be difficult to consistently cover the surface of the carrier core material, and a lowering of resistance of the carrier may occur due to abrasion of the resin covering layer during long periods of use. If the average thickness exceeds 5 μm, the strength of the resin covering layer may be weaker, peeling thereof from the core material is likely to occur, and the covering layers of the carrier particles are likely to stick to one another during carrier production. As a result, it may not be possible to obtain a covering layer with a uniform thickness.

—Carrier Fabrication Method—

A method for fabrication of the carrier is not particularly limited and conventionally known carrier fabrication methods can be used, and the following fabrication methods can be mentioned.

That is, the following can be mentioned: an immersion process in which a solution for forming the resin covering layer is prepared (a solution including a matrix resin for forming the resin covering layer and, as necessary, conductive particles, resin particles for charge control and the like) and the core material is immersed in the resin covering layer formation solution: a spray process in which the resin covering layer formation solution is sprayed at surfaces of the core material; a fluid bed process in which the resin covering layer formation solution is sprayed in a state in which the core material is suspended by flowing air; a kneader-coater process in which the core material and the resin covering layer forming solution are mixed in a kneader-coater and then the solvent is removed; and the like. However, the method is not particularly limited to processes that use a solution. For example, depending on the type of core material of the carrier, it is also possible to use a powder-coating process in which the core material and a resin powder are together heated and mixed, or the like. Further; after the resin coating layer has been formed, heat treatment may be performed with a device such as an electric furnace, a kiln or the like.

A solvent to be used in a resin covering layer formation solution for forming the resin covering layer is not particularly limited as long as it dissolves the resin. For example, the following can be used: aromatic hydrocarbons such as xylene, toluene and the like; ketones such as acetone, methyl ethyl ketone and the like; ethers such as tetrahydrofuran, dioxane and the like; halides such as chloroform, carbon tetrachloride and the like; and the like.

The carrier obtained in this manner should have a magnetism at 1 kOe in a range from 170 emu/$cm^3$ to 250 emu/$cm^3$, and preferably in a range from 185 emu/$cm^3$ to 235 emu/$cm^3$.

If the magnetism of the carrier is less than 170 emu/$cm^3$, magnetic stress on a developing roller 46 will be lower and results will be apparent in image flaws such as image dropouts and the like. Because magnetic restraining force to the developing roller 46 will be low, flying dispersal of the toner and/or the carrier from the developing roller 46 may occur, and image flaws caused by soiling of other members and image flaws caused by carrier adherence to the photoreceptor may result. On the other hand, if the magnetism of the carrier exceeds 250 emu/cm$^3$, magnetic restraining force to the developing roller 46 will be larger. Consequently, stresses on the toner will be larger, external additives on the surface of the toner parent particles may be embedded and it may not be possible to realize a buffering function of the external additives, and image flaws such as image dropouts and the like may result.

Herein, the magnetism of a carrier is measured using a vibrating sample magnetometer BHV-525 (produced by Riken Denshi Co., Ltd.) using a fixed amount sample in a VSM ordinary temperature sample case for powder (H-2902-151), in a 1 kOe magnetic field after a precise measurement of the weight.

Furthermore, the carrier according to the present invention may have sphericity in a range from 0.980 (or about 0.980) to 1.000 (or about 1.000), preferably in a range from 0.985 to 1.000.

If the sphericity of the carrier is less than 0.980, fluidity of the carrier will be poor and fluidity of the developer will be insufficient, and it may consequently not be possible to obtain uniformity in a magnetic brush.

Sphericity of a carrier in the present invention means an average degree of roundness as measured by the following method.

As a measurement sample, 200 mg of carrier is added to 30 mL of an ethylene glycol aqueous solution and stirred. Carrier in a residue that is left when supernatant liquid is removed is used, and measurement is performed by the following method. For the measurement, an FPIA-3000 (produced by Sysmex Corporation) is used, image analysis is carried out on at least 5,000 individual carrier particles which are imaged, and an average roundness is found by statistical processing. For this, individual roundnesses are found from the following equation (1).

$$\text{roundness}=\text{circumferential length of an equivalent circle/circumferential length}=[2\times(A\times\pi)^{1/2}]/PM \qquad \text{Equation (1)}$$

(In equation (1), A represents a projected area of a carrier particle and PM represents a circumferential length of the carrier particle.)

Here, the measurements are performed with a dilution magnification of ×10 in an LPF mode (a low resolution mode). For the analysis of the data, with the objective of removing measurement noise, the analysis is performed with a number particle diameter analysis range of from 3 μm to 80 μm and a roundness analysis range of from 0.850 to 1.000.

The volume average particle diameter of the carrier in the present invention is preferably in a range from 25 μm to 100 μm, more preferably in a range from 25 μm to 80 μm, and even more preferably in a range from 25 μm to 60 μm.

If the volume average particle diameter of the carrier is less than 25 μm, magnetism of each carrier particle will be weak, magnetic restraining force to the developing roller 46 (described in detail later) will be weak, and adherence of the carrier to the image holding member 12 may occur. On the other hand, if the volume average particle diameter of the carrier exceeds 100 μm, shapes of the particles will be distorted from spheres, and reproduction of fine lines may be poor.

Herein, the volume average particle diameter of the carrier means a value measured using a laser diffraction/scattering-type particle size distribution measuring instrument (LS PARTICLE SIZE ANALYZER LS13 320, produced by BECKMAN COULTER). The particle size distribution that is obtained is divided into particle size ranges (channels). Therefrom, a volume cumulative distribution is taken, from the small particle diameter side, and a particle diameter for an accumulation of 50% of all the particles serves as the volume average particle diameter $D_{50v}$.

A density of the carrier is preferably from 2.0 g/cm$^3$ to 5.0 g/cm$^3$, more preferably from 2.5 g/cm$^3$ to 5.0 g/cm$^3$, and even more preferably from 3.0 g/cm$^3$ to 4.5 g/cm$^3$.

If the density is less than 2.0 g/cm$^3$ the toner will be close to a state of fluidity, and consequently a charge contribution capability will be reduced. If the density is greater than 5.0 g/cm$^3$, a drop in fluidity of the carrier will occur and a total energy amount will tend to increase to exceed an upper limit, which would not be preferable.

Herein, a method for measurement of density of the carrier is a measurement based on the method described in the density section of "Butsuri Kagaku Jikkenho" ("Physical Chemistry Experimental Methods", published by Tokyo Kagaku Dozin Co., Ltd., third edition), the disclosure of which is incorporated herein by reference. The measurement is performed using water with an electrical resistance of at least 17 MΩ, with a measurement temperature of 25° C.

A volume resistivity of the carrier in the present invention is preferably controlled into a range from $1\times10^7$ Ω·cm to $1\times10^{15}$ Ω·cm, more preferably a range from $1\times10^8$ Ω·cm to $1\times10^{14}$ Ω·cm, and even more preferably a range from $1\times10^8$ Ω·cm to $1\times10^{13}$ Ω·cm.

If the volume resistivity of the carrier exceeds $1\times10^{15}$ Ω·cm, resistance will be high, it will be difficult for the carrier to work as a development electrode during development, edge effects may arise, particularly at solid image portions, and solid reproduction may deteriorate. On the other hand, if the volume resistivity is less than $1\times10^7$ Ω·cm, resistance will be lower. As a result, problems are likely to arise in that, when toner density in the developer falls, charges will be injected from the developing roller into the carrier, and the carrier itself will be developed.

The volume resistivity of the carrier (Ω·cm) is measured as follows. A measurement environment has temperature 20° C. and humidity 50% RH.

Carrier which is to be a measurement object is smoothly laid on a surface of a circular jig provided with a 20 cm$^2$ electrode plate, such that the carrier has a thickness of about 1 to 3 mm, and a layer of carrier is formed. A similar 20 cm$^2$ electrode plate is placed thereon, sandwiching the carrier layer. In order to eliminate gaps within the carrier, a 4 kg weight is applied to the electrode plate above the carrier layer, after which a thickness (cm) of the carrier layer is measured. An electrometer and a high voltage power supply generator are connected to the two electrodes above and below the carrier layer. High voltage is applied so as to form an electric field of $10^{3.8}$ V/cm between the two electrodes, and a current value (A) flowing at this time is acquired. Hence, the volume resistivity (Ω·cm) of the carrier is calculated. A formula for calculation of the volume resistivity (Ω·cm) is as shown in the following equation (2).

$$R=E\times 20/(I-I_0)/L \quad \text{Equation (2)}$$

In the above equation (2), R represents the volume resistivity of the carrier (Ω·cm), E represents the applied voltage (V), I represents the current value (A), $I_0$ represents a current value (A) for an applied voltage of 0 V and L represents the thickness of the carrier layer (cm). The coefficient '20' represents the area of the electrode plates ($cm^2$).

Next, parts of the apparatus of the image forming device 10 will be described.

The charging roller 14 is provided to contact the surface of the image holding member 12, and electrostatically charges the surface of the image holding member 12 by rotating in accordance with rotary driving of the image holding member 12.

The charging roller 14 is structured such that voltage can be applied from a high-voltage power supply 29, is charged by high voltage applied to the charging roller 14 from the high-voltage power supply 29, and charges the surface of the image holding member 12 with the charge on the charging roller 14.

Figure 2:
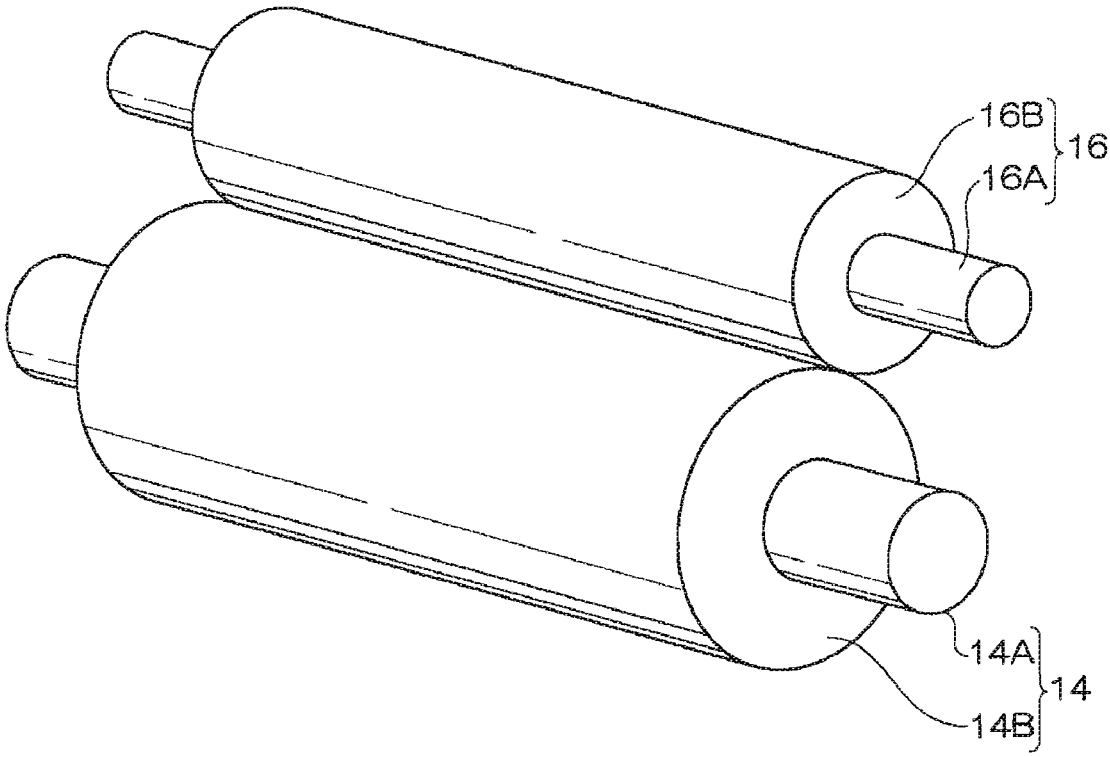
FIG. 2 is a schematic view showing a charging roller and a cleaning roller of one exemplary embodiment of the present invention.

As shown in FIG. 2, the charging roller 14 has a structure in which a charging layer 14B is formed around a conductive shaft 14A, and the shaft 14A is rotatably supported.

The charging roller 14 is pushed against the image holding member 12, and is disposed to be pressed against the image holding member 12 so as to passively rotate with rotation of the image holding member 12. Herein, it is also possible to attach a driving unit to the charging roller 14 so as to rotate the charging roller 14 at a different rotation speed from the image holding member 12.

As the shaft 14A of the charging roller 14, a molded product having conductivity is used, generally of iron, copper, brass, stainless steel, aluminum, nickel or the like. It is also possible to use a resin molded product in which conductive particles or the like are dispersed, or the like.

As the charging layer 14B, for example, a layer having conductivity may be used, generally a layer in which conductive particles or semiconductive particles are dispersed in a rubber member.

As a rubber, the following may be used: EPDM, polybutadiene, natural rubber, polyisobutylene, SBR, CR, NBR, silicon rubber, urethane rubber, epichlorhydrine rubber, SBS, thermoplastic elastomers norbonene rubber, fluorosilicone rubber, ethylene oxide rubber, and the like.

As conductive particles or semiconductive particles, the following may be used: carbon black; metals such as zinc, aluminum, copper, iron, nickel, chrome, titanium and the like; and metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, MgO and the like. These materials may be used singly or in mixtures of two or more.

A structure is possible in which a resistive layer and a protective layer are laminated over the charging layer 14B.

The resistive layer and the protective layer are layers in which conductive particles or semiconductive particles are dispersed in binder resin(s), to control resistances thereof. Volume resistivities may be from $10^3$ Ω·cm (or about $10^3$ Ω·cm) to $10^{14}$ Ω·cm (or about $10^{14}$ Ω·cm), desirably from $10^5$ Ωcm to $10^{12}$ Ω·cm, and more desirably from $10^7$ Ω·cm to $10^{12}$ Ω·cm. Layer thicknesses of the resistive layer and the protective layer may be from 0.01 μm to 1000 μm, desirably from 0.1 μm to 500 μm, and more desirably from 0.5 μm to 100 μm.

As a binder resin, an acryl resin, a cellulose resin, a polyamide resin, methoxymethylated nylon, ethoxymethylated nylon, a polyurethane resin, a polycarbonate resin, a polyester resin, a polyethylene resin, a polyvinyl resin, a polyarylate resin, a polythiophene resin, a polyolefin resin such as PFA, FEP, PET or the like, a styrene-butadiene resin, or the like may be used.

As conductive particles or semi conductive particles, similarly to a resilient layer, carbon black, a metal or a metal oxide may be used. Further, as necessary, an oxidation inhibitor such as hindered phenol, hindered amine or the like, a filler such as clay, kaolin or the like, a lubricant such as silicone oil or the like, and suchlike may be added.

As means for forming these layers, the following may be used: a blade coating method, a Mayer bar coating method, a spray coating method, an immersion coating method, a bead coating method, an air knife coating method, a curtain coating method and the like.

As a method for charging the image holding member 12 using the charging roller 14, there are a method of applying a DC voltage to the charging roller 14 and a method of applying a superposed DC voltage and AC voltage. The method of applying DC voltage is desirable. In particular, with the DC voltage alone, because no AC voltage is being applied when the surface of the image holding member 12 is being charged, an amount of current flowing into the image holding member 12 is extremely small.

However, applying a DC voltage alone is more susceptible to soiling of the surface of the charging roller 14 than a case of superposed application of DC voltage and AC voltage to the charging roller 14. A reason for this is that when a DC voltage and AC voltage are applied in superposition, positive and negative electric fields are continuously alternated at the surface of the charging roller 14 due to the application of the AC voltage. Consequently, contaminants that are charged positively or negatively are subjected to electrostatic forces repelling them from the surface of the charging roller 14. As a result, it is possible to remove adherents from the surface of the charging roller 14 relatively easily, which is preferable.

In regard to ranges of voltage, a DC voltage is preferably from 50 V to 2000 V, positive or negative, depending on a required charging potential of the image holding member 12, and is particularly desirably from 100 V to 1500 V. If an AC voltage is superposed, a peak-to-peak voltage is from 400 V to 1800 V, desirably from 800 V to 1600 V, and more desirably, from 1200 V to 1600 V is desirable. A frequency of the AC voltage is from 50 Hz to 20,000 Hz, desirably from 100 Hz to 5,000 Hz.

As shown in FIG. 1 and FIG. 2, the cleaning roller 16 is disposed to contact an outer peripheral surface of the charging roller 14, removes adherents that have adhered to the charging roller 14, including the inorganic particles, from the charging roller 14, and forms aggregations in which the removed inorganic particles are aggregated.

In the present exemplary embodiment, the "aggregations" in which the inorganic particles are aggregated indicates a state in which the inorganic particles included in the toner of the developer described above have been detached from the toner, and the detached inorganic particles have aggregated with one another and grown to a size which is visible to the naked eye.

The cleaning roller 16 is disposed in a state in which an outer periphery thereof is pressed against the outer periphery of the charging roller 14, and is structured with a porous layer 16B provided on an outer periphery surface of a core 16A. Unillustrated springs are provided at two end portions of the core 16A, and the cleaning roller 16 is pushed against the charging roller 14 with a predetermined pressure by these springs. Thus, because the cleaning roller 16 is disposed in a state of being pressed against the outer periphery of the charging roller 14, the porous layer 16B is resiliently deformed along the outer peripheral surface of the charging roller 14 and a contact region is formed.

An unillustrated motor is linked to a support shaft of the image holding member 12. When the image holding member 12 is driven to rotate in a predetermined direction (the direction of arrow A in FIG. 1), the charging roller 14 turns to follow the rotation of the image holding member 12, and thus the surface of the image holding member 12 is charged. The cleaning roller 16 rotates to follow the charging roller 14, and adhesion of the inorganic particles and the like that have adhered to the charging roller 14 are removed from the charging roller 14 by the rotation of the cleaning roller 16.

As the core 16A, a molded product, generally of iron, copper, brass, stainless steel, aluminum, nickel or the like, is used. It is also possible to use a resin molded product in which conductive particles or the like are dispersed, or the like, as the core 16A.

The porous layer 16B is formed of a foam of a porous material with a three-dimensional structure. Hollows, uneven portions and the like (below referred to as cells) are present at interior portions, the surface and the like, and the porous layer 16B has resilience.

Because the outer periphery of the cleaning roller 16 is formed with the porous layer 16B of the present exemplary embodiment, the cleaning roller 16 removes adherents that have adhered onto the charging roller 14, including the inorganic particles, from the charging roller 14, and forms aggregations in which the removed inorganic particles are aggregated.

The porous layer 16B is formed of a material selected from foam-forming resins and rubbers, such as polyurethane, polyethylene, polyamide, olefin, melamine or polypropylene, NBR, EPDM, natural rubber or styrene-butadiene rubber, or chloroprene, silicone, nitrile or the like.

Of these, it is possible to use polyurethane, which is strong in tearing, tensile strength and the like, in order to clean off the toner effectively by passive rotation with the charging roller 14 while not damaging the surface of the charging roller 14 by abrasion from the cleaning roller 16, and in order not to cause tearing or damage over long periods.

This polyurethane is not particularly limited, and will be acceptable if formed by a reaction between a polyol, such as polyester polyol, polyether, acryl polyol or the like, and an isocyanate, such as 2,4-tolylene diisocyanate, 2,6-tolylene diisocyanate, 4,4-diphenyl methane diisocyanate, tolylene diisocyanate, 1,6-hexamethylene diisocyanate or the like. This may be mixed with a chain extender such as 1,4-butane diol, trimethylol propane or the like. It is common to use a foaming agent such as water, an azo compound such as azodicarbonamide, azobisisobutyronitrile or the like, or the like to cause foaming. Further, as necessary, assistants such as a foaming assistant, a foaming regulator, a catalyst and the like may be added.

More specifically, the porous layer 16B has an interconnected cell structure and has a hardness from 150 N to 500 N.

Further, a bite amount of the porous layer 16B against the charging roller 14 is from 0.2 mm (or about 0.2 mm) to 1.5 mm (or about 1.5 mm).

An average pore diameter of the cells (pores) in the surface of the porous layer 16B is in a range from 1000 to 8000 times the volume average particle diameter of the inorganic particles included in the developer.

For the present exemplary embodiment, a "interconnected cell structure" means a structure in which numerous cells are included internally and neighboring air cells are linked with one another.

Further, for the present exemplary embodiment, 'hardness' is measured by the following method. The material that constitutes the porous layer 16B is sliced into a sheet 400 mm high by 400 mm wide by 50 mm deep, and a load is applied to a central portion of the sliced sheet by a compression jig with diameter 200 mm. A force (N) required to compress the thickness by 25% is referred to as hardness for the present invention. To measure the force required for the compression, a load measurement instrument (MODEL-1311) produced by AIKOH is used.

The hardness of the porous layer 16B may be from 150 N to 500 N, desirably from 170 N to 450 N, and more desirably from 190 N to 400 N. When the hardness is in these ranges, the cleaning roller 16 is provided with sufficient cleaning ability, and it is possible to form aggregations of inorganic particles from the inorganic particles removed from the charging roller 14 and subsequently removed inorganic particles.

With a hardness of less than 150 N, even if sufficient force is generated at a time of recovery after the contact region formed by contact of the above-described cleaning roller 16 against the charging roller 14, the action of removing adherents on the charging roller 14 will be reduced, and excellent cleaning ability will not be exhibited.

On the other hand, if the hardness is greater than 500 N, the cleaning roller surface will be damaged in a short time, very small stripe-form defects may arise in images, and it may be difficult to form aggregations of the inorganic particles.

A measurement of the hardness is based on JIS K 6400-2, which is incorporated herein by reference. A 50×380×380 mm test piece is cut off, and is pressed in a perpendicular direction to 75% of an initial thickness. Then, the load is removed, the sample is again pressed to 25% of the original thickness, and a load when 20 seconds has passed in this static state is read.

A cell count (a number of foam cells) in the interconnected cell structure of the porous layer 16B is preferably in a range from 40/25 mm to 80/25 mm, more desirably in a range from 45/25 mm to 75/25 mm, and even more desirably in a range from 48/25 mm to 70/25 mm. When the cell count is in these ranges, the cleaning roller may exhibit excellent cleaning ability.

If the cell count is less than 40/25 mm, an action of the cleaning roller 16 itself rubbing adherents on the charging roller 14 against the surface of the charging roller 14 may increase, and soiling of the surface of the charging roller 14 may be made worse. On the other hand, if the cell count is greater than 80/25 mm, problems may arise such as strength of skeleton portions of the foam, which include networks structured by the fine cells, falling, the cleaning roller 16 itself being likely to tear or peel off, a reduction in repellent resilience resulting, and cleaning ability being adversely affected. The cell count can be controlled by an addition amount of a known foaming agent such as carbon dioxide gas, a fluorine-based compound or the like.

A measurement of the cell count is performed by visual observation using an optical microscope. A line with length 50 mm is drawn at an arbitrary location of the surface of a 100×100×10 mm test piece, cells that cross the line are counted, and the number of cells/25 mm is found. These lines are drawn at three arbitrary locations of the test piece, and an average of values at the three locations serves as the cell count.

The bite amount of the porous layer 16B against the charging roller 141 is preferably from 0.2 mm to 1.5 mm, more preferably from 0.3 mm to 1.3 mm, and particularly preferably from 0.3 mm to 1.0 mm.

Provided the bite amount is not less than 0.2 mm, it is possible to suppress a situation in which the porous layer 16B freely rotates rather than following rotation of the charging roller 14 and the cleaning function is reduced. Further; provided the bite amount is not more than 1.5 mm, the inorganic particles removed from the charging roller 14 may be retained on the porous layer 16B, further inorganic particles removed from the charging roller 14 are supplied to the retained inorganic particles, and thus aggregations of the inorganic particles may be formed.

The average pore diameter of the cells (pores) in the surface of the porous layer 16B is preferably in a range from 1000× to 8000× the volume average particle diameter of the inorganic particles included in the developer, more preferably in a range from 1500× to 7000×, and particularly preferably in a range from 2000× to 6000×.

Provided the average pore diameter of the cells in the surface of the porous layer 16B is from 1000× to 8000× the volume average particle diameter of the inorganic particles included in the developer, the inorganic particles will be effectively removed from the surface of the charging roller 14 and temporarily retained in the cells. Moreover, because the inorganic particles removed from the surface of the charging roller 14 are retained, the inorganic particles retained on the cleaning roller 16 (the porous layer 16B) may be caused to grow and form the inorganic particle aggregations.

The cleaning roller 16 may be insulative and may be conductive. That is, a conduction layer may be insulative and may be conductive.

A method for providing conductivity to the cleaning roller 16 is not particularly limited, such as a method of kneading a conductive material into the resilient layer, a method of blowing conductive powder therein or the like, but it is desirable to use an immersion process in which the cleaning roller 16 is immersed in a conductive coating material with volume resistivity regulated to a range of from $10^3$ Ω·cm (or about $10^3$ Ω·cm) to $10^{10}$ Ω·cm (or about $10^{10}$ Ω·cm) (preferably from $10^4$ Ω·cm to $10^8$ Ω·cm). With the immersion process, it is possible to form the cleaning roller 16 with extremely stable volume resistivity, and costs may be kept very low. The conductive coating material may be a material in which carbon is dispersed in a urethane, silicone, styrene or the like and dissolved in a solvent (for example, ethyl acetate, toluene, methyl ethyl ketone or the like), or suchlike.

As a method for fabrication of the cleaning roller 16, for example, the following can be mentioned: injecting a raw material into a mold and causing foaming, and covering a core material with a urethane foam of the required shape; a method of slab-molding a urethane foam, machining the foam to the required shape by grinding or the like to prepare the porous layer 16B, and then covering the core 16A with the porous layer 16B; and the like.

The exposure apparatus 18 forms an electrostatic latent image at the surface of the image holding member 12 by exposing the surface of the image holding member 12 that has been charged by the charging roller 14 with laser light modulated in accordance with image data.

As the exposure apparatus 18, for example, a laser optics system, an LED lens array or the like may be used.

The developing apparatus 20 supplies the developer used in the present exemplary embodiment to the surface of the image holding member 12, thus developing the electrostatic latent image formed at the surface of the image holding member 12 and forming a toner image.

Figure 3:
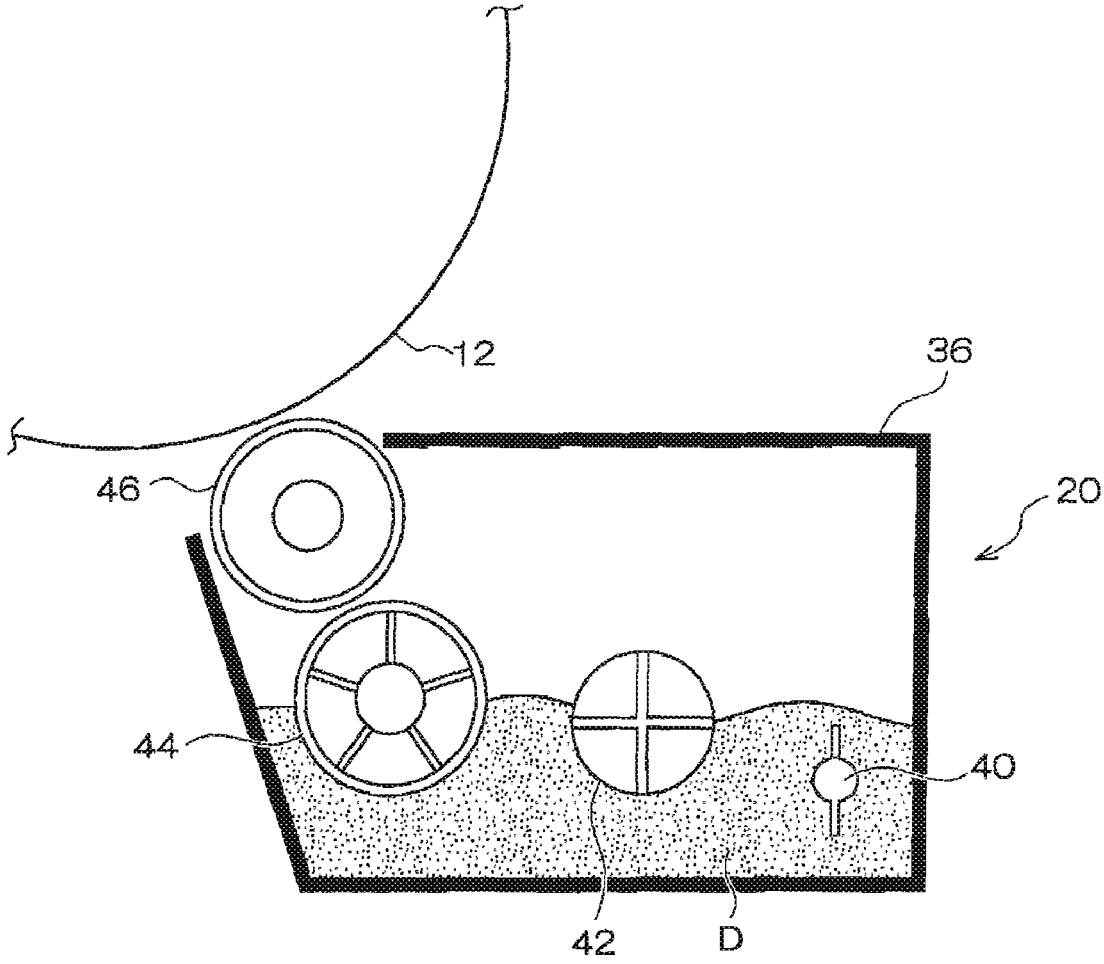
FIG. 3 is a schematic sectional view showing structure of a developing apparatus of one exemplary embodiment of the present invention.

As shown in FIG. 3, the developing apparatus 20 is provided with a developer housing 36 and the developing roller 46. The developer housing 36 is disposed adjacent to the image holding member 12 and accommodates the developer. The developing roller 46 is disposed within the developer housing 36 to be rotatable about an axis, so as to adjoin the image holding member 12. The interior of the developer housing 36 is loaded with the developer D, which is constituted by the toner and the carrier. Inside the developer housing 36, a stirring paddle 40 and a stirring screw 42 are driven to rotate, and thus the toner and the carrier are stirred and the toner electrostatically adheres to the carrier. Hence, the developer D, in which the toner is adhered to the carrier, is adhered by magnetic force to a developer transport roller 44, which has magnetism. The developer D is transported to the developing roller 46, and is adhered by magnetic force to the developing roller 46, which is a magnetic roller. A developing bias is applied to the developing roller 46 that faces the image holding member 12, and the toner in the developer D transfers from the developing roller 46 to regions on the image holding member 12 at which the electrostatic latent image has been formed. In this manner, the electrostatic latent image on the image holding member 12 is developed by the developer, and the toner image is formed in accordance with the electrostatic latent image.

The transfer apparatus 22 nips the recording medium 24 between the transfer apparatus 22 and the image holding member 12 and conveys the recording medium 24, and transfers the toner image that has been formed on the image holding member 12 onto the recording medium 24. The recording medium 24 to which the toner image has been transferred is conveyed to a location at which the fixing apparatus 26 is disposed by unillustrated conveyance rollers, heat and/or pressure is applied by the fixing apparatus, and thus the toner image is fixed onto the recording medium 24. In this manner, a toner image is formed on the recording medium 24. The recording medium 24 on which the toner image has been formed is conveyed out of the image forming device 10 by unillustrated conveyance rollers or the like.

Toner on the image holding member 12 that is not transferred by the transfer apparatus 22 but stays retained on the image holding member 12 and adhesion of paper dust and the like are removed by the cleaning apparatus 28.

As the transfer apparatus 22, the fixing apparatus 26 and the cleaning apparatus 28, conventionally known members and devices may be used.

In the image forming device 10 structured as described above, an electrostatic latent image is formed by the exposure apparatus 18 after the image holding member 12 has been charged by the charging roller 14. When, by rotation of the image holding member 12, a region of the image holding member 12 at which the electrostatic latent image has been formed reaches a region at which the image holding member 12 and the developing roller 46 of the developing apparatus 20 oppose one another, the toner is provided from the developing roller 46 to the electrostatic latent image, and a toner image corresponding to that electrostatic latent image is formed.

Then when, by the rotation of the image holding member 12, the region of the image holding member 12 at which this toner image has been formed reaches a region at which the image holding member 12 and the transfer apparatus 22 oppose one another, the toner image on the image holding member 12 is transferred to the recording medium 24 by the transfer apparatus 22.

Then when, by the rotation of the image holding member 12, the region of the image holding member 12 from which the toner image has been transferred to the recording medium 24 by the transfer apparatus 22 reaches the location at which the cleaning blade 28A is disposed, adherents on the image holding member 11, such as residual toner that was not engaged in the transfer and the like, are removed by the cleaning blade 28A. When, by the rotation of the image holding member 12, this region from which the adherents have been removed reaches the location at which the charging roller 14 is disposed, this region of the image holding member 12 is charged by the charging roller 14, and the above-described process is repeated.

Now, in ideal conditions, residual toner on the image holding member 12 would be completely removed from the surface of the image holding member 12 by the cleaning apparatus 28. However, in practice, a portion of toner components will pass through between the cleaning apparatus 28 and the image holding member 12, which is to say, in the present exemplary embodiment, the inorganic particles may reach the charging roller 14.

Cases in which the toner parent particles pass through between the image holding member 12 and the cleaning apparatus 28 together with the inorganic particles can be expected. However, in the present exemplary embodiment, as described earlier, the toner is particles in which the inorganic particles with a volume average particle diameter in the range from 80 nm to 300 nm have been externally added to toner parent particles. Consequently, at a blade nipping portion, the inorganic particles are detached from the toner surfaces and form a dam in the blade nipping portion, and this obstructs ingression of the toner parent particles further into the blade nipping portion. Therefore, it is thought that at least the toner parent particles will be effectively removed from the image holding member 12 by the cleaning apparatus 28. However, it is thought that if the inorganic particles pass through between the cleaning apparatus 28 and the image holding member 12, the inorganic particles will reach the charging roller 14.

When adherents such as inorganic particles and the like on the image holding member 12 reach the location at which the charging roller 14 is disposed due to the rotation of the image holding member 12, because the charging roller 14 is disposed to contact the surface of the image holding member 12, the adherents adhere to the surface of the charging roller 14. The adherents such as inorganic particles and the like that have adhered to the surface of the charging roller 14 are removed from the surface of the charging roller 14 by the cleaning roller 16.

At the charging roller 14, the cleaning roller 16 with the structure described earlier is disposed to contact the charging roller 14 and is provided so as to rotate following rotation of the charging roller 14. In the present exemplary embodiment, because the toner has the constitution in which the inorganic particles in the aforementioned range of volume average particle diameter are externally added to the toner parent particles, adherents including the organic particles may be transferred to the cleaning roller 16 without the surface of either the charging roller 14 or the cleaning roller 16 being abraded or deteriorating.

Moreover, because the surface of the cleaning roller 16 is structured by the porous layer 16B provided with the aforementioned conditions as explained earlier, the inorganic particles from the surface of the charging roller 14 are retained in the pores (cells) in the porous layer 16B of the cleaning roller 16, and are grown by further inorganic particles being removed from the charging roller 14 and transferring onto the cleaning roller 16. Thus, the aggregations of the inorganic particles are formed. That is, by the adherents at the surface of the charging roller 14 being removed by the cleaning roller 16, a state arises in which aggregations of the inorganic particles removed from the charging roller 14 are retained at the surface of the cleaning roller 16.

When an aggregation retained at the surface of the cleaning roller 16 attains a size above a certain level, gravity acting on the aggregation is larger than the Van Der Waals force, and consequently the aggregation separates from the cleaning roller 16 and transfers to the surface of the image holding member 12 via the charging roller 14. Therefore, deterioration of the cleaning roller 16 itself may be suppressed.

With the rotation of the image holding member 12, inorganic particle aggregations that have adhered to the image holding member 12 pass between the developing apparatus 20 and the image holding member 12, and reach the region of opposition with the transfer apparatus 22.

Now, as a developer in a conventional image forming device, a developer is generally used which uses a ferrite carrier (a constitution that simply includes magnetic particles as a core material and a resin covering layer; This constitution is different from a constitution as in the present exemplary embodiment that includes a core material in which magnetic particles are dispersed in resin and a resin covering layer which covers the core material). With a developer that uses such a previous carrier, an effect occurs in which the electrostatic latent image on the image holding member 12 is disordered when the toner is supplied from the developing roller 46 to the image holding member 12 (a "scavenging phenomenon").

Consequently, with a carrier of a previous technology, it would be expected that the aggregated state of the inorganic particle aggregations would be eliminated by the scavenging effect occurring between the developing roller 46 and the image holding member 12, and the aggregations would be taken into the developing apparatus 20.

EXAMPLES

Herebelow, the present invention will be described by Examples. The present invention is not to be limited by these Examples. In the Examples, "parts" and "%", unless specifically explained, mean "parts by weight" and "% by weight".

—Methods of Measuring Various Characteristics—

Firstly, methods for measuring physical characteristics of toner and the like used in the Examples and Comparative Examples will be described.

~Volume Average Particle Diameter of Particles and the Like~

Volume average particle diameters of particles and the like are measured using a laser diffraction-scattering-type particle size distribution measuring instrument (HORIBA LA-910). Sodium polyphosphate is added, to 0.1%, into a 0.5% aqueous solution of an anionic surfactant (NEWREX PASTE H, produced by NOF Corporation). To this inorganic particles or a small-diameter external additive to be measured are added, and this is dispersed by ultrasound for 1 minute and used as a measurement sample.

~Shape Coefficient~

A shape coefficient ($ML^2/A$) is a coefficient defined by the following equation (3).

$$(ML^2/A)=(\text{absolute maximum length of a toner particle})^2/(\text{projected area of the particle})\times(\pi/4)\times 100 \quad \text{Equation (3)}$$

Measurements of the absolute maximum lengths of particles (toner) and the projected areas of the particles are implemented using a LUZEX image analysis device (produced by Nireco Corporation, FT). Toner spread over a glass slide is acquired at the LUZEX image analysis device, through an optical microscope and a video camera, and image processing is performed.

Example 1

Fabrication of Toner A

~Preparation of a Resin Microparticle Dispersion Liquid~

Styrene 296 parts
n-Butyl acrylate 104 parts
Acrylic acid 6 parts
Dodecane thiol 10 parts
Divinyl adipinate 1.6 parts (the above produced by Wako Pure Chemical K.K.)

A mixture in which the above components has been mixed and dissolved is added to a solution in which 12 parts of a non-ionic surfactant (NONIPOL 400, produced by Sanyo Chemical laboratory Co., Ltd.) and 8 parts of an anionic surfactant (NEOGEN SC, produced by Dai-ichi Kogyo Seiyaku Co., Ltd.) have been dissolved in 610 parts of ion exchange water. This is then dispersed in a flask and emulsified. This is slowly mixed for 10 minutes while 50 parts of ion exchange water in which 8 parts of ammonium persulfate (produced by Wako Pure Chemical K.K.) have been dissolved is added. Then nitrogen substitution is performed for 20 minutes at 0.1 L/minute. Thereafter, this is stirred in a flask while being heated in an oil bath until the contents reached 70° C. Staying in this state, emulsion polymerization continued for 5 hours, and a resin microparticle dispersion liquid (1) with an average particle diameter of 200 nm and a solid content concentration of 40% is prepared. A portion of this dispersion liquid is placed on a 100° C. oven, and moisture is removed. A DSC (differential scanning calorimetry) measurement is performed on the dispersion liquid from which the moisture has been removed, giving a glass transition temperature of 53° C. and a weight average molecular weight of 32,000.

~Preparation of a Coloring Agent Dispersion Liquid~

C.I. Pigment Blue 15:3 (phthalocyanine-based pigment produced by Dainichiseika Color & Chemicals Mfg. Co., Ltd.: CYANINE BLUE 4937) 100 parts (or Dainichiseika Color & Chemicals Mfg. Co., Ltd. product: SEIKA FAST YELLOW 2054)

Anionic surfactant (produced by Dai-ichi Kogyo Seiyaku Co., Ltd.: NEOGEN RK) 10 parts Ion exchange water 490 parts The above components are mixed and dissolved, stirred for 10 minutes using a homogenizer (ULTRA-TURRAX, produced by IKA Group), and a coloring agent dispersion (Y) is prepared.

~Preparation of a Release Agent Particle Dispersion Liquid~

Paraffin wax (produced by Nippon Seiro Co., Ltd.: HNP-9) 100 parts

Anionic surfactant (produced by Lion Corporation: LIPAL 860K) 10 parts

Ion exchange water 390 parts

The above components are mixed and dissolved, then dispersed using a homogenizer (ULTRA-TURRAX, produced by IKA Group), and subjected to a dispersion treatment by a pressure ejection-type homogenizer. Thus, a release agent particle dispersion liquid in which release agent particles (the paraffin wax) with an average particle diameter of 220 nm are dispersed is prepared.

~Production of Toner Parent particles A~

The resin particle dispersion liquid 320 parts

The coloring agent dispersion liquid 80 parts

The release agent particle dispersion liquid 96 parts

Aluminum sulfate (produced by Wako Pure Chemical K.K.) 1.5 parts

Ion exchange water 1270 parts

The above components are held in a round stainless steel flask with a jacket for temperature regulation, and dispersed for 5 minutes at 5,000 rpm using a homogenizer (ULTRA-TURRAX T 50, produced by IKA Group). This is then transferred to a flask and left for 20 minutes at 25° C. while being stirred with a quadruple paddle. Thereafter, this is stirred while being heated with a mantle heater with a rate of temperature rise of 1° C./minute until the contents are at 48° C., and is held at 48° C. for 20 minutes. Next, an additional 80 parts of the resin particle dispersion liquid is slowly added, and this is held at 48° C. for 30 minutes. Thereafter, a 1 N aqueous solution of sodium hydroxide is added, to adjust the pH to 6.5.

Then, this is heated to 95° C. with a rate of temperature rise of 1° C./minute, and held for 30 minutes. A 0.1 N nitric acid solution is added to adjust the pH to 4.8, and this is left for 2 hours at 95° C. Thereafter; more of the 1 N sodium hydroxide aqueous solution is added, to adjust the pH to 6.5, and this is left for 5 hours at 95° C. Then, this is cooled to 30° C. at 5° C./minute.

A toner particle dispersion liquid obtained is filtered, and then: (A) 2,000 parts of ion exchange water at 35° C. is added to the obtained toner particles, (B) this is left while being stirred for 20 minutes, and (C) this is then filtered. Operations (A) to (C) are repeated five times, and then toner particles on a filter paper are transferred to a vacuum-dryer and dried for 10 hours at 45° C. at 1000 Pa or less. This setting of 1000 Pa or less is because the aforementioned toner particles are in a water-containing state so, even at 45° C., the water content would freeze in the initial stage of drying, the moisture would sublimate thereafter, and consequently internal pressure in the dryer would not be constant during depressurization. After drying ends, the pressure is stable at 100 Pa. After the interior of the dryer returns to normal pressure, the toner particles are taken out, and toner parent particles A are obtained.

~Preparation of Toner A~

1.5 parts by weight of monodispersed spherical silica (sol-gel process, average particle diameter 120 nm) and 1 part by weight of anatase-form titanium dioxide (volume average particle diameter 20 nm) are added to 100 parts by weight of the toner parent particles A (volume average particle diameter 6 μm, $ML^2/A$ 135, color cyan), and this is blended for 10 minutes using a Henschel mixer with a circumferential speed of 32 m/s, Then, using a sieve with meshes of 106 μm, oversize particles are removed, and a toner A to which inorganic particles have been externally added is obtained.

Note that the above-mentioned monodispersed spherical silica corresponds to the inorganic particles which are externally added to the toner parent particles as described in the above exemplary embodiment, and the anatase-form titanium dioxide corresponds to the small-diameter external additive described in the above exemplary embodiment.

~Preparation of Core Particles A~

40 parts by weight of phenol, 60 parts by weight of formaline, 400 parts by weight of magnetite (processed product with average particle diameter 0.20 μm, spherical shape, 2% by weight methyl trimethoxysilane), 12 parts by weight of ammonia water and 60 parts by weight of ion exchange water are added. This is mixed and stirred while being steadily heated to 85° C., is reacted for 4 hours, and is hardened. Thereafter, this is cooled, filtered, washed and dried, and spherical core particles A with a particle diameter of 37.3 μm are obtained.

~Preparation of Carrier A~

Core particles A 100 parts

Covering layer formation solution A

Toluene 120 parts

Styrene-methyl methacrylate copolymer (ratio by weight 60:40, weight average molecular weight 80,000) 2.0 parts Carbon black (REGAL 330, produced by Cabot Corporation) 0.4 parts The above components, apart from the core particles, are stirred and dispersed in a stirrer for 60 minutes, and the covering layer formation solution A is prepared. Then, this solution A and the core particles A are put into a vacuum deaeration-type kneader (product name KHO-5, produced by Inoue Manufacturing Co., Ltd.), and stirred for 20 minutes at 60° C. Thereafter, while being heated, this is depressurized and deaerated, dried, and passed through a mesh with meshes of 106 μm. Thus, a carrier A is fabricated. The volume average particle diameter of this carrier A is 39.1 μm and the sphericity is 0.989.

~Preparation of Developer A~

100 parts by weight of the carrier A prepared as described above and 8 parts by weight of the toner A are mixed in a V blender and sifted with a 500-μm mesh, and a developer A is fabricated.

~Evaluation~

The developer A prepared as described above is loaded into a developing apparatus and the toner A is loaded into a toner cartridge. A brush cleaner which has been provided at a charger is removed from a DOCUCENTRE-II C4300 produced by Fuji Xerox Co., Ltd., and the cleaning roller 16, with the following structure, is provided to serve as the aggregation-forming unit of the image forming device according to the present invention.

For the core 16A, a cylindrical member with diameter 4 mm of the material SUM plated with nickel is used. As the porous layer 16B covering the surface of the core 16A, the porous layer 16B that is used is structured of foamed urethane foam with thickness 2.5 mm (i.e., the diameter of the cleaning roller 16 including the core 16A is 9 mm).

The average pore diameter of the cells (pores) in the surface of the porous layer 16B is 3500× the volume average particle diameter of the inorganic particles included in the developer A.

The hardness of the porous layer 16B is 300 N, and the cell count in the interconnected cell structure (foam cell count) is 60/25 mm.

The bite amount of the porous layer 16B against the charging roller 14 is 0.5 nm.

With the image forming device of the structure described above, in a low-temperature, low-humidity environment (10° C., 30% RH), continuous output of sets of five sheets of an original document with an image coverage of 20% is performed. A total of 50,000 A4 sheets are printed continuously. During this continuous printing of 50,000 sheets, at each 10,000 sheets, an image of a full-coverage halftone image (with image density 30%) is formed on 10 sheets of A4 paper (J paper, produced by Fuji Xerox Co., Ltd.). Thus, after completion of the output of 50,000 sheets, 50 sheets of the halftone image have been obtained, in batches of 10 sheets at 10,000 sheets, 20,000 sheets, 30,000 sheets, 40,000 sheets and 50,000 sheets. The reason for performing continuous output of sets of five sheets is that, because printing is paused after each five sheets, strain on the cleaning blade is larger, thus accelerating the evaluation.

On the total of 50 sheets at which the full-coverage halftone 30% image is formed, the presence or absence of image defects (image dropouts) is verified with naked eve. Not even one dropout can be identified.

Then, this image forming device is moved to a high-temperature, high-humidity environment (30° C. 80% RH) and seasoned. Thereafter, the halftone image (image density 30%) is printed on 10 sheets of A4 paper, and the presence or absence of image defects (image dropouts) is verified with naked eye. Not even one dropout can be identified. A judgment standard of this evaluation is that if there are 20 or fewer dropouts on the 50 sheets printed in low temperature and low humidity, this is evaluated as 'good', and if there are 10 or fewer dropouts on the 10 sheets printed in high temperature and high humidity, this is 'good'.

Example 2

Preparation of Toner A

The toner A prepared in Example 1 is used.

~Preparation of Carrier B~

30 parts by weight of a styrene/n-butyl methacrylate copolymer and 70 parts by weight of a magnetic powder (MG-Z, produced by Mitsui Mining & Smelting Co., Ltd.) are kneaded by a pressurized kneader, pulverized by a jet mill and classified by an air classifier, and a carrier B with a volume average particle diameter of 48 μm is obtained.

The sphericity of this carrier B is 0.974.

~Preparation of Developer B~

100 parts by weight of the carrier B prepared as described above and 8 parts by weight of the toner A are mixed in a V blender and sifted with a 500-μm mesh, and a developer B is fabricated.

~Evaluation~

An image evaluation is carried out in the same manner as in Example 1, except that the developer B as prepared for the present Example 2 is used instead of the developer A used in Example 1. In the low-temperature, low-humidity environment, no dropouts can be identified, and in the high-temperature, high-humidity environment, dropouts are identified at three places on the 10 sheets.

Example 3

Preparation of Toner C

A toner C is obtained in the same manner as the preparation of the above-described preparation of toner A for Example 1, except that 0.6 parts by weight of monodispersed spherical silica (sol-gel process, average particle diameter 80 nm) is used instead of the 1.5 parts by weight of monodispersed spherical silica (sol-gel process, average particle diameter 120 nm).

~Preparation of Developer C~

A developer C is fabricated in the same manner as in Example 1 except that toner C is used instead of the aforementioned toner A.

~Evaluation~

An image evaluation is carried out in the same manner as in Example 1, except that the developer C and toner C as prepared for the present Example 3 are used instead of the developer A and toner A used in Example 1. In the low-temperature, low-humidity environment, two dropouts occur on the 50 sheets, and in the high-temperature, high-humidity environment, five dropouts are identified on the 10 sheets.

Example 4

Preparation of Toner D

A toner D is obtained in the same manner as the preparation of the above-described preparation of toner A for Example 1, except that 2.1 parts by weight of monodispersed spherical silica (sol-gel process, average particle diameter 200 nm) is used instead of the 1.5 parts by weight of monodispersed spherical silica (sol-gel process, average particle diameter 120 nm).

~Preparation of Developer D~

A developer D is fabricated in the same manner as in Example 1 except that toner D is used instead of the aforementioned toner A of Example 1.

~Evaluation~

An image evaluation is carried out in the same manner as in Example 1, except that the developer D and toner I) as prepared for the present Example 4 are used instead of the developer A and toner A used in Example 1. In the low-temperature, low-humidity environment, three dropouts occur on the 50 sheets, and in the high-temperature, high-humidity environment, five dropouts are identified on the 10 sheets.

Example 5

Preparation of Toner E

A toner E is obtained in the same manner as the preparation of the above-described preparation of toner A for Example 1, except that 2.2 parts by weight of monodispersed spherical silica (sol-gel process, average particle diameter 300 nm) is used instead of the 1.5 parts by weight of monodispersed spherical silica (sol-gel process, average particle diameter 120 nm).

~Preparation of Developer E~

A developer E is fabricated in the same manner as for Example 1 except that toner E is used instead of the toner A prepared for Example 1.

~Evaluation~

An image evaluation is carried out in the same manner as in Example 1, except that the developer E and toner E as prepared for the present Example 5 are used instead of the developer A and toner A used in Example 1. In the low-temperature, low-humidity environment, five dropouts occur on the 50 sheets, and in the high-temperature, high-humidity environment, seven dropouts are identified on the 10 sheets.

Example 6

An image evaluation is carried out with an image forming device in the same manner as in Example 1, except that a cleaning roller 16-2 with the following structure is used instead of the cleaning roller 16 used for Example 1.

For a core 16-2A, a cylindrical member with diameter 4 mm of the material SUM plated with nickel is used. As a porous layer 16-2B covering the surface of the core 16-2A, the porous layer 16-2B that is used is constituted of foamed urethane foam with thickness 2.5 mm (i.e., the diameter of the cleaning roller 16-2 including the core 16-2A is 9 mm).

The average pore diameter of the cells (pores) in the surface of the porous layer 16-2B is 2600× the volume average particle diameter of the inorganic particles included in the developer A.

The hardness of the porous layer 16-2B is 400 N, and the cell count in the interconnected cell structure (foam cell count) is 80/25 mm.

The bite amount of the porous layer 16-2B against the charging roller 14 is 0.3 mm.

~Evaluation~

The image evaluation is carried out with the image forming device in the same manner as in Example 1, except that the cleaning roller 16-2 as prepared for the present Example 6 is used instead of the cleaning roller 16 used in Example 1. In the low-temperature, low-humidity environment, six dropouts occur on the 50 sheets, and in the high-temperature, high-humidity environment, four dropouts are identified on the 10 sheets.

Example 7

An image evaluation is carried out with an image forming device in the same manner as in Example 1, except that a cleaning roller 16-3 with the following structure is used instead of the cleaning roller used for Example 1.

For a core 16-3A, a cylindrical member with diameter 4 mm of the material SUM plated with nickel is used. As a porous layer 16-3B covering the surface of the core 16-3A, the porous layer 16-3B that is used is constituted of foamed urethane foam with thickness 2.5 mm (i.e., the diameter of the cleaning roller 16-3 including the core 16-3A is 9 mm).

The average pore diameter of the cells (pores) in the surface of the porous layer 16-3B is 5200× the volume average particle diameter of the inorganic particles included in the developer A.

The hardness of the porous layer 16-3B is 200 N, and the cell count in the interconnected cell structure (foam cell count) is 40/25 mm.

The bite amount of the porous layer 16-3B against the charging roller 14 is 1.0 mm.

~Evaluation~

The image evaluation is carried out with the image forming device in the same manner as in Example 1, except that the cleaning roller 16-3 as prepared for the present Example 7 is used instead of the cleaning roller 16 used in Example 1. In the low-temperature, low-humidity environment, no dropouts can be identified, and in the high-temperature, high-humidity environment, seven dropouts are identified on the 10 sheets.

Comparative Example 1

An image evaluation is carried out with an image forming device in the same manner as in Example 1, except that a developer F with the following constitution is used instead of the developer A used in Example 1.

~Preparation of Carrier F~

Cu—Zn ferrite particles F (volume average particle diameter 35 μm) 100 parts by weight Covering layer formation solution F Toluene 40 parts by weight Styrene-methacrylate copolymer (ratio by weight 60:40) 3 parts by weight Carbon black (REGAL 330, produced by Cabot Corporation) 0.4 parts by weight The above components, apart from the Cu—Zn ferrite particles F, are stirred and dispersed in a stirrer for 60 minutes, and the covering layer formation solution F is prepared. Then, this solution F and the Cu—Zn ferrite particles F are put into a vacuum deaeration-type kneader (product name KHO-5, produced by Inoue Manufacturing Co., Ltd.), and stirred for 20) minutes at 60° C. Thereafter, this is depressurized while being heated, and deaerated, dried, and passed through a mesh with meshes of 106 μm. Thus, a carrier F is fabricated.

~Preparation of Developer F~

A developer F is fabricated in the same manner as in Example 1, except that carrier F is used instead of carrier A.

~Evaluation~

The image evaluation is carried out in the same manner as in Example 1, except that the developer F as prepared for the present Comparative Example 1 is used instead of the developer A used in Example 1. In the low-temperature, low-humidity environment, 28 dropouts occur on the 50 sheets, and in the high-temperature, high-humidity environment, 28 dropouts are identified on the 10 sheets.

Comparative Example 2

An image evaluation is carried out with an image forming device in the same manner as in Example 1, except that a developer G with the following constitution and toner particles G are used instead of the developer A used in Example 1.

~Preparation of Toner Particles G~

2 parts by weight of evaporation process silica (average particle diameter 40 nm) and 1 part by weight of anatase-form titanium dioxide (volume average particle diameter 20 nm) are added to 100 parts by weight of the aforementioned toner parent particles A prepared as for Example 1, and this is blended for 10 minutes using a Henschel mixer with a circumferential speed of 32 m/s. Then, using a sieve with meshes of 106 μm, oversize particles are removed, and toner G is obtained.

~Preparation of Developer G~

Developer G is fabricated in the same manner as in Example 1 except that toner G is used instead of toner A.

~Evaluation~

An image evaluation is carried out in the same manner as in Example 1, except that the toner G and developer G as prepared for the present Comparative Example 2 are used instead of the developer A used in Example 1. In the low-temperature, low-humidity environment, colored stripes appear and accordingly image formation is halted at 42 kPV, In this state, the charging roller and the cleaning roller are inspected with naked eye, and adhesion of toner is seen.

Comparative Example 3

Preparation of Toner H

A toner H is obtained in the same manner as the preparation of the above-described preparation of toner A for Example 1, except that 0.8 parts by weight of monodispersed spherical silica (sol-gel process, average particle diameter 70 nm) is used instead of the 1.5 parts by weight of monodispersed spherical silica (sol-gel process, average particle diameter 120 nm).

~Preparation of Developer H~

A developer H is fabricated in the same manner as in Example 1 except that toner H is used instead of toner A.

~Evaluation~

An image evaluation is carried out in the same manner as in Example 1, except that the toner H and developer H as prepared for the present Comparative Example 3 are used instead of the developer A used in Example 1. In the low-temperature, low-humidity environment, colored stripes appear and accordingly image formation is halted at 48 kPV. In this state, the charging roller and the cleaning roller are inspected with naked eye, and adhesion of toner are seen, Comparative Example 4

Preparation of Toner I

A toner I is obtained in the same manner as the preparation of the above-described preparation of toner A for Example 1, except that 0.8 parts by weight of monodispersed spherical silica (sol-gel process, average particle diameter 320 nm) is used instead of the 115 parts by weight of monodispersed spherical silica (sol-gel process, average particle diameter 120 nm).

~Preparation of Developer I~

A developer I is fabricated in the same manner as in Example 1 except that toner I is used instead of toner A.

~Evaluation~

An image evaluation is carried out in the same manner as in Example 1, except that the developer I and toner I as prepared for the present Comparative Example 4 are used instead of the developer A used in Example 1. In the low-temperature, low-humidity environment, 65 dropouts occur on the 50 sheets, and in the high-temperature, high-humidity environment, 32 dropouts are identified on the 10 sheets.

Comparative Example 5

An image evaluation is carried out with an image forming device in the same manner as in Example 1, except that a cleaning pad with the following structure is used instead of the cleaning roller used in Example 1.

A solid pad formed of PORON (urethane foam) is pressed against the charging roller 14 with a bite amount of 0.5 mm.

~Evaluation~

The image evaluation is carried out with the image forming device in the same manner as in Example 1, except that the above-mentioned cleaning pad fabricated for the present Comparative Example 5 is used instead of the cleaning roller used in Example 1. In the low-temperature, low-humidity environment, colored stripes appear and accordingly image formation is halted at 35 kPV. In this state, the charging roller is inspected with naked eye, and adhesion of large quantities of the inorganic particles is seen.

What is claimed is:

1. An image forming device comprising:

an image holding member that is driven to rotate;

a charging member that, by contacting a surface of the image holding member and rotating in accordance with rotation of the image holding member, contact-charges the image holding member;

a latent image-forming unit that forms an electrostatic latent image on the image holding member that has been charged by the charging member;

a developing unit that develops the electrostatic latent image formed on the image holding member with a developer including a toner and a carrier to form a toner image in accordance with the electrostatic latent image, the toner comprising an external additive having first inorganic particles with a volume average particle diameter of about 80 nm to about 300 nm and second inorganic particles with a volume average particle diameter of about 7 nm to about 60 nm, and the carrier including a core material having a magnetic powder dispersed in a resin and a resin covering layer that covers the core material;

a transfer unit that transfers the toner image to a transfer-receiving member;

a removal unit that removes adherents on the image holding member; and an aggregation-forming unit that, by contacting a surface of the charging member and rotating in accordance with rotation of the charging member, removes adherents that have adhered to the surface of the charging member, including the first inorganic particles, from the surface of the charging member, and forms aggregations in which the removed first inorganic particles are aggregated.

2. The image forming device according to claim 1, wherein the content of the inorganic particles with respect to toner parent particles is from about 0.5% by weight to about 2.5% by weight.

3. The image forming device according to claim 1, wherein the content of the second inorganic particles with respect to toner parent particles is from about 0.5% by weight to about 3.0% by weight.

4. The image forming device according to claim 1, wherein surfaces of the first inorganic particles have been hydrophobized with a hydrophobizing agent.

5. The image forming device according to claim 1, wherein the toner further comprises a binder resin and the binder resin is a styrene-alkyl acrylate copolymer and/or a styrene-alkyl methacrylate copolymer.

6. The image forming device according to claim 1, wherein the toner further comprises a release agent, and the content of the release agent is from about 1% by weight to about 20% by weight with respect to an amount of toner parent particles.

7. The image forming device according to claim 1, wherein the value of (volume average particle diameter/number average particle diameter) as an index of the particle size distribution of the toner is about 1.6 or less.

8. The image forming device according to claim 1, wherein the magnetic powder is iron oxide.

9. The image forming device according to claim 1, wherein the particle diameter of the magnetic powder is from about 0.01 μm to about 1 μm.

10. The image forming device according to claim 1, wherein the content of the magnetic powder in the core material of the carrier is from about 30% by weight to about 99% by weight.

11. The image forming device according to claim 1, wherein the average thickness of the resin covering layer is from about 0.1 μm to about 5 μm.

12. The image forming device according to claim 1, wherein the sphericity of the carrier is from about 0.980 to about 1.000.

13. The image forming device according to claim 1, wherein the aggregation-forming unit comprises a core and a porous layer formed at an outer periphery of the core.

14. The image forming device according to claim 13, wherein the electric conductivity of the porous layer is from about $10^3$ Ω·m to about $10^{10}$ Ω·cm.

15. The image forming device according to claim 13, wherein the porous layer comprises a urethane foam.

16. The image forming device according to claim 1, wherein the volume resistivity of the charging member is from about $10^3$ Ω·cm to about $10^{14}$ Ω·cm.

17. The image forming device according to claim 1, wherein a voltage applied to the charging member is from about 50 V to about 2,000 V, and can be either plus or minus.

18. An image forming device comprising:

an image holding member that is driven to rotate;

a charging member that, by contacting a surface of the image holding member and rotating in accordance with rotation of the image holding member, contact-charges the image holding member;

a latent image-forming unit that forms an electrostatic latent image on the image holding member that has been charged by the charging member;

a developing unit that develops the electrostatic latent image formed on the image holding member with a developer including a toner and a carrier to form a toner image in accordance with the electrostatic latent image, the toner comprising an external additive having first inorganic particles with a volume average particle diameter of about 80 nm to about 300 nm, wherein surfaces of the first inorganic particles have been hydrophobized with a hydrophobizing agent and an amount of the hydrophobizing agent with respect to an amount of the first inorganic particles is from about 5% by weight to about 50% by weight, and the carrier including a core material having a magnetic powder dispersed in a resin and a resin covering layer that covers the core material;

a transfer unit that transfers the toner image to a transfer-receiving member;

a removal unit that removes adherents on the image holding member; and an aggregation-forming unit that, by contacting a surface of the charging member and rotating in accordance with rotation of the charging member, removes adherents that have adhered to the surface of the charging member, including the first inorganic particles, from the surface of the charging member, and forms aggregations in which the removed first inorganic particles are aggregated.

19. An image forming device comprising:

an image holding member that is driven to rotate;

a charging member that, by contacting a surface of the image holding member and rotating in accordance with rotation of the image holding member, contact-charges the image holding member;

a latent image-forming unit that forms an electrostatic latent image on the image holding member that has been charged by the charging member;

a developing unit that develops the electrostatic latent image formed on the image holding member with a developer including a toner and a carrier to form a toner image in accordance with the electrostatic latent image, the toner comprising an external additive having first inorganic particles with a volume average particle diameter of about 80 nm to about 300 nm, wherein surfaces of the first inorganic particles have been hydrophobized with a hydrophobizing agent and the hydrophobicity of the external additive after hydrophobization with the hydrophobizing agent is from about 40% to about 100%, and the carrier including a core material having a magnetic powder dispersed in a resin and a resin covering layer that covers the core material;

a transfer unit that transfers the toner image to a transfer-receiving member;

a removal unit that removes adherents on the image holding member; and an aggregation-forming unit that, by contacting a surface of the charging member and rotating in accordance with rotation of the charging member, removes adherents that have adhered to the surface of the charging member, including the first inorganic particles, from the surface of the charging member, and forms aggregations in which the removed first inorganic particles are aggregated.

20. An image forming device comprising:

an image holding member that is driven to rotate;

a charging member that, by contacting a surface of the image holding member and rotating in accordance with rotation of the image holding member, contact-charges the image holding member;

a latent image-forming unit that forms an electrostatic latent image on the image holding member that has been charged by the charging member;

a developing unit that develops the electrostatic latent image formed on the image holding member with a developer including a toner and a carrier to form a toner image in accordance with the electrostatic latent image, the toner comprising an external additive having first inorganic particles with a volume average particle diameter of about 80 nm to about 300 nm and a Wadell sphericity of at least about 0.6, and the carrier including a core material having a magnetic powder dispersed in a resin and a resin covering layer that covers the core material;

a transfer unit that transfers the toner image to a transfer-receiving member;

a removal unit that removes adherents on the image holding member; and an aggregation-forming unit that, by contacting a surface of the charging member and rotating in accordance with rotation of the charging member, removes adherents that have adhered to the surface of the charging member, including the first inorganic particles, from the surface of the charging member, and forms aggregations in which the removed first inorganic particles are aggregated.

21. An image forming device comprising:

an image holding member that is driven to rotate;

a charging member that, by contacting a surface of the image holding member and rotating in accordance with rotation of the image holding member, contact-charges the image holding member;

a latent image-forming unit that forms an electrostatic latent image on the image holding member that has been charged by the charging member;

a developing unit that develops the electrostatic latent image formed on the image holding member with a developer including a toner and a carrier to form a toner image in accordance with the electrostatic latent image, the toner comprising an external additive having first inorganic particles with a volume average particle diameter of about 80 nm to about 300 nm, and the carrier including a core material having a magnetic powder dispersed in a resin and a resin covering layer that covers the core material, the resin covering layer comprising conductive particles;

a transfer unit that transfers the toner image to a transfer-receiving member;

a removal unit that removes adherents on the image holding member; and an aggregation-forming unit that, by contacting a surface of the charging member and rotating in accordance with rotation of the charging member, removes adherents that have adhered to the surface of the charging member, including the first inorganic particles, from the surface of the charging member, and forms aggregations in which the removed first inorganic particles are aggregated.

22. The image forming device according to claim 21, wherein the content of the conductive particles is from about 1% by weight to about 50% by weight.

23. An image forming device comprising:

an image holding member that is driven to rotate;

a charging member that, by contacting a surface of the image holding member and rotating in accordance with rotation of the image holding member, contact-charges the image holding member;

a latent image-forming unit that forms an electrostatic latent image on the image holding member that has been charged by the charging member;

a developing unit that develops the electrostatic latent image formed on the image holding member with a developer including a toner and a carrier to form a toner image in accordance with the electrostatic latent image, the toner comprising an external additive having first inorganic particles with a volume average particle diameter of about 80 nm to about 300 nm, and the carrier including a core material having a magnetic powder dispersed in a resin and a resin covering layer that covers the core material;

a transfer unit that transfers the toner image to a transfer-receiving member;

a removal unit that removes adherents on the image holding member; and an aggregation-forming unit that, by contacting a surface of the charging member and rotating in accordance with rotation of the charging member, removes adherents that have adhered to the surface of the charging member, including the first inorganic particles, from the surface of the charging member, and forms aggregations in which the removed first inorganic particles are aggregated, the aggregation-forming unit comprising a core and a porous layer formed at an outer periphery of the core, wherein a bite amount of the porous layer against the charging member is from about 0.2 mm to about 1.5 mm.

* * * * *